US007523706B2

(12) United States Patent
Schneider et al.

(10) Patent No.: US 7,523,706 B2
(45) Date of Patent: Apr. 28, 2009

(54) METHOD FOR ADJUSTING THE TRANSFER OF PRINTING INK

(75) Inventors: Georg Schneider, Würzburg (DE); Wolfgang Otto Reder, Veitshöchheim (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 1 day.

(21) Appl. No.: 11/794,686

(22) PCT Filed: Dec. 30, 2005

(86) PCT No.: PCT/EP2005/057231

§ 371 (c)(1),
(2), (4) Date: Jul. 3, 2007

(87) PCT Pub. No.: WO2006/072559

PCT Pub. Date: Jul. 13, 2006

(65) Prior Publication Data

US 2008/0041258 A1 Feb. 21, 2008

(30) Foreign Application Priority Data

| | | |
|---|---|---|
| Jan. 5, 2005 | (DE) | 10 2005 000 856 |
| Feb. 4, 2005 | (DE) | 10 2005 005 303 |
| May 18, 2005 | (WO) | PCT/EP2005/052287 |

(51) Int. Cl.

| | |
|---|---|
| ***B41F 23/04*** | (2006.01) |
| ***B41F 1/54*** | (2006.01) |
| ***B41F 1/66*** | (2006.01) |
| ***B41L 5/12*** | (2006.01) |
| ***B41L 39/00*** | (2006.01) |
| ***B41L 47/56*** | (2006.01) |

(52) U.S. Cl. ..... 101/487; 101/484

(58) Field of Classification Search ..... 101/487, 101/491, 484, 483
See application file for complete search history.

(56) References Cited

U.S. PATENT DOCUMENTS

| | | | | |
|---|---|---|---|---|
| 3,741,115 | A | 6/1973 | Keller | |
| 5,189,960 | A | 3/1993 | Valentini et al. | |
| 5,595,115 | A | 1/1997 | Rau et al. | |
| 5,720,221 | A | 2/1998 | Harig et al. | |
| 6,209,456 | B1 * | 4/2001 | Murray et al. | 101/487 |

(Continued)

FOREIGN PATENT DOCUMENTS

| | | |
|---|---|---|
| DE | 1 953 590 | 6/1971 |

(Continued)

*Primary Examiner*—Anthony H Nguyen
*Assistant Examiner*—Leo T Hinze
(74) *Attorney, Agent, or Firm*—Jones, Tullar & Cooper, P.C.

(57) ABSTRACT

Transfer of printing ink is adjusted using a first roller in an inking unit of a printing machine, which transfers ink to a forme cylinder. A temperature control unit enables an outer surface of the first roller to reach a required temperature and/or to enable an outer surface of the forme cylinder to reach the required temperature. That temperature control unit can be either controlled or regulated by an adjusting device. Specific curves or reference points for an interrelationship between a production speed of a printing machine and the respective required temperature on the outer surface of the forme cylinder, or on the outer surface of the first roller are stored in a storage unit of the adjusting device for various printing inks or ink types.

21 Claims, 11 Drawing Sheets

U.S. PATENT DOCUMENTS

| | | | | |
|---|---|---|---|---|
| 6,679,169 | B2 | 1/2004 | Anweiler et al. | |
| 6,766,743 | B2 * | 7/2004 | Hayashi et al. | 101/487 |
| 7,004,070 | B2 | 2/2006 | Schneider et al. | |
| 7,021,215 | B2 | 4/2006 | Schneider et al. | |
| 7,089,855 | B2 | 8/2006 | Schneider et al. | |
| 7,143,695 | B2 | 12/2006 | Schneider et al. | |
| 7,261,034 | B2 * | 8/2007 | Schneider et al. | 101/487 |
| 2002/0112636 | A1 | 8/2002 | Desaulniers et al. | |
| 2006/0201366 | A1 * | 9/2006 | Schneider et al. | 101/483 |
| 2008/0011171 | A1 * | 1/2008 | Schneider et al. | 101/350.1 |

FOREIGN PATENT DOCUMENTS

| | | | |
|---|---|---|---|
| DE | 39 04 854 | C1 | 4/1990 |
| DE | 44 31 188 | A1 | 5/1995 |
| DE | 44 26 083 | A1 | 1/1996 |
| DE | 296 08 045 | U1 | 9/1996 |
| DE | 694 02 737 | T2 | 7/1997 |
| DE | 197 36 339 | A1 | 4/1999 |
| DE | 102 45 702 | A1 | 5/2003 |
| DE | 101 57 271 | A1 | 6/2003 |
| DE | 102 18 359 | A1 | 11/2003 |
| DE | 10 2004 044 215 | A1 | 12/2005 |
| EP | 0 652 104 | A1 | 10/1994 |
| EP | 1 609 599 | A2 | 11/2002 |
| EP | 1 609 599 | A3 | 3/2006 |
| WO | WO 03/045694 | A1 | 6/2003 |
| WO | WO 03/045695 | | 6/2003 |

* cited by examiner

METHOD FOR ADJUSTING THE TRANSFER OF PRINTING INK

CROSS-REFERENCE TO RELATED APPLICATIONS

This application is the U.S. national phase, under 35 USC 371, of PCT/EP2005/057231, filed Dec. 30, 2005; published as WO 2006/072559 A1 on Jul. 13, 2006 and claiming priority to DE 10 2005 000 856.9, filed Jan. 5, 2005; to DE 10 2005 005 303.3, filed Feb. 4, 2005 and to PCT/EP2005/052287, filed May 18, 2005, the disclosures of which are expressly incorporated herein by reference.

FIELD OF THE INVENTION

The present invention is directed to a method for regulating the transfer of printing ink. A first roller is arranged in an inking system of a printing press and transfers ink to a forme cylinder. A desired temperature is set by a temperature regulating device of the first roller on the first roller's surface. A desired temperature is also set on the surface of the forme cylinder by a forme cylinder temperature regulating device. The temperature regulating devices are controlled or are regulated by an adjusting device.

BACKGROUND OF THE INVENTION

A temperature-regulated system for printing presses is disclosed in DE 694 02 737 T2. A compression device selectively makes available a temperature-regulating medium for cooling, as well as for heating purposes, which medium is usable for regulating the temperature of inking system rollers of several printing attachments. This takes place by the selective provision of a heat exchanger with the compressed temperature-regulating medium, which medium is subsequently cooled in a condenser and is finally expanded and, in the other case by the use of a bypass with a non-expanded, and therefore hot, temperature-regulating medium. Either cooling or heating of a secondary circuit of a temperature-regulating medium, passing through the rollers, takes place in the heat exchanger. Regulation of the temperature of the medium in the secondary circuit takes place by metering this temperature-regulating medium by the use of a temperature sensor and with a control valve in every individual roller.

A system for temperature regulation is known from DE 296 08 045 U1. A first cooling device, with a first cooling process and with a first fluid circuit, is provided for cooling a dampening medium and is thermally connected, on the one hand, via a heat exchanger with the dampening medium supply circuit for the dampening medium and, on the other hand, thermally, via a second heat exchanger, with a second fluid circuit, which second fluid circuit, in turn, is thermally coupled with a second cooling process configured as a cooling tower.

DE 44 26 083 A1 discloses a temperature-regulating arrangement. A temperature-regulating fluid, for regulating the temperature of a roller, can be conducted, in its circulation, to be selectively in thermal contact, via a heat exchanger, with a cooled fluid circuit, or via a heating heat exchanger.

Methods are known from WO 03/045694 A1 and from WO 03/045695 A1 wherein, by regulating the temperature of a rotating component of a printing attachment, which works together with printing ink, the tackiness of the printing ink on the rotating component can be maintained substantially constant within a temperature range between 22° C. and 50° C. The tackiness of the printing ink is a function of the temperature on the shell face of the rotating component and the production speed of the rotating component. Application of these methods consist, in particular, in a waterless-printing attachment, and preferably in a printing attachment for newspaper printing.

EP 0 652 104 A1 discloses a printing attachment for waterless offset printing. A regulating arrangement is provided with several regulating devices which, for preventing the buildup of printing ink on a transfer cylinder of the printing attachment, regulate, based on a desired value, a respective control valve for regulating the amount of a coolant, such as, for example, water, that is supplied to the respective cylinders. The regulation is accomplished as a function of the deviation from a temperature determined by a respective thermal sensor at the transfer cylinder, or at a forme cylinder of the printing press which is assigned to the transfer cylinder, or at an ink distribution cylinder of an inking system which is assigned to the forme cylinder. Maintaining the temperature of a printing forme, which is arranged on the forme cylinder, constant during the printing process by the use of the regulated amount of coolant is made possible, for example, within a temperature range between 28° C. and 30° C. The temperature of the transfer cylinder is to be maintained at approximately 34° C. to 35° C. and the temperature of the inking system is to be maintained between 25° C. and 27° C. Along with the supply of an amount of coolant, there is also provided an option for pre-warming the printing system. The result is that plucking of the printing ink at the start of printing, together with the collection of paper particles in the inking system, can be prevented. A temperature curve of the coolant, for pre-warming, can be regulated in accordance with a temperature-time curve entered, for example, into a memory unit which is housed in the regulating device.

A temperature-regulating device in a printing attachment is known from DE 197 36 339 A1/B4. The rheological properties, such as, for example, tackiness, among others, of printing inks and other fluids are affected by the temperature regulation. The associated printing press, with a forme cylinder, has a short inking system with an ink duct, a screen roller and an ink application roller. At least one of the inking group rollers, or the forme cylinder, can be temperature- regulated by the temperature-regulating device. Temperature regulation takes place by cooling or by warming from either the direction of the shell face of the inking system rollers or of the forme cylinder, or in the interior of the inking system rollers or the forme cylinder. In addition, the temperature of the ink duct can also be regulated, and in particular also the temperature of the doctor blade for removing excess printing ink from the screen roller. The amount of printing ink which is transferred to the forme cylinder can be regulated by the use of a control loop. An optical density, which is measured on the material to be imprinted, is used as the signal value, by the use of which the regulating device, which is assigned to the temperature-regulating device, regulates their temperatures.

DE-OS 19 53 590 discloses a printing attachment with an inking system and a dampening system, the temperature of which can be regulated by the use of a temperature-regulating device. A desired value of the temperature can be determined as a function of influencing variables, such as, for example, the printing speed, prior to the start of the printing process, or can be set by the use of tables. An advantageous upper limit of the temperature of the printing ink is stated to be the room temperature.

It is known from DE 39 04 854 C1 that the speed of rotation of the cylinders of the printing attachment, of the inking system and of the dampening system, have an effect on the inking system temperature.

In DE 44 31 188 A1 a printing forme of a printing attachment for waterless offset printing is cooled to approximately 28 to 30° C.

A method for the control of the ink supply in a machine for processing material to be imprinted, and having at least one inking system, is known from DE 102 45 702 A1. At least the physical properties of the printing ink and/or the material to be imprinted are known data. The stored data are read into an ink control mode, which is stored in the computer. Optimal setting regarding the ink supply is performed on the basis of this ink control model prior to the start of printing, or in the course of the printing process.

SUMMARY OF THE INVENTION

The object of the present invention is directed to providing a method for regulating the transfer of printing ink.

In accordance with the present invention, this object is attained by the provision of a first inking system roller, which is adapted to transfer ink to a forme cylinder, and which has a desired surface temperature set by a first roller temperature regulating device. A desired temperature on the surface of the forme cylinder is set by a forme cylinder temperature regulating device. At least one adjusting device is used to set temperatures using the temperature regulating devices. Color-specific curves or set points, which are printing ink color or type specific, are stored in a memory unit of the adjusting device at least for a connection between a production speed of the printing press and the desired cylinder shell face temperature.

The advantages to be realized by the present invention consist, on the one hand, in that a regulation and/or adjustment of the respective desired temperature value at the shell face of the forme cylinder or at the shell face of the first roller for different colors of printing ink, or color types, is possible for the operators of a printing press in a comfortable way by the use of a display and/or input mask on a monitor of an input and output unit of a regulating device. Corresponding color-specific curves or support points, which define a connection between a production speed of the printing press and the respective desired temperature at the shell face of the forme cylinder, or at the shell face of the first roller, are stored in a memory unit of the regulating device. These can preferably be displayed, selected and changed in the display and/or input mask.

It is moreover advantageous that a conveying rate of a screen roller, which picks up printing ink from a reservoir and which transfers it to an adjoining rotating body, can be kept at least approximately constant. In the case of an increase in the production speed of the printing press, as constant as possible an amount of ink is conveyed to the material to be imprinted, in spite of the reduction of the capability of the screen roller for the transfer of printing ink occurring along with this, because of an increasingly incomplete emptying of the screen roller's small cups. On the other hand, by a regulation of the temperature at the shell face of the forme cylinder in particular, which temperature regulation is dependent on the production speed of the printing press, the value of the tackiness of the printing ink that is transported by the forme cylinder is maintained in a range suitable for the printing process. Plucking of the printing ink at the surface of the material to be imprinted, in particular, is thus prevented. The printing ink is matched, in regard to its splitting and holding capabilities, as a function of the production speed of the printing press by a setting, which meets the requirements, of its temperature to the actually occurring printing process. The setting of its temperature takes place indirectly by setting the temperature at the shell face of a rotating body which is conducting this printing ink. To prevent waste, because of inappropriate temperature-dependent properties of the ink used for printing, and typically occurring in the course of an intended change of the production speed of the printing press, the different chronological behavior for performing the adaptation to the temperature of the printing ink and for performing the adaptation of the production speed of the printing press are taken into consideration. The possibility of changing a condition of the press, for example manually, within defined limits is also considered. In this way performing a fine adjustment, directed to the provision of a good quality of the printed product, can be accomplished. All these measures contribute to maintaining the quality of a product which is produced by the printing press on a high level in spite of a change in the production speed of the printing press.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
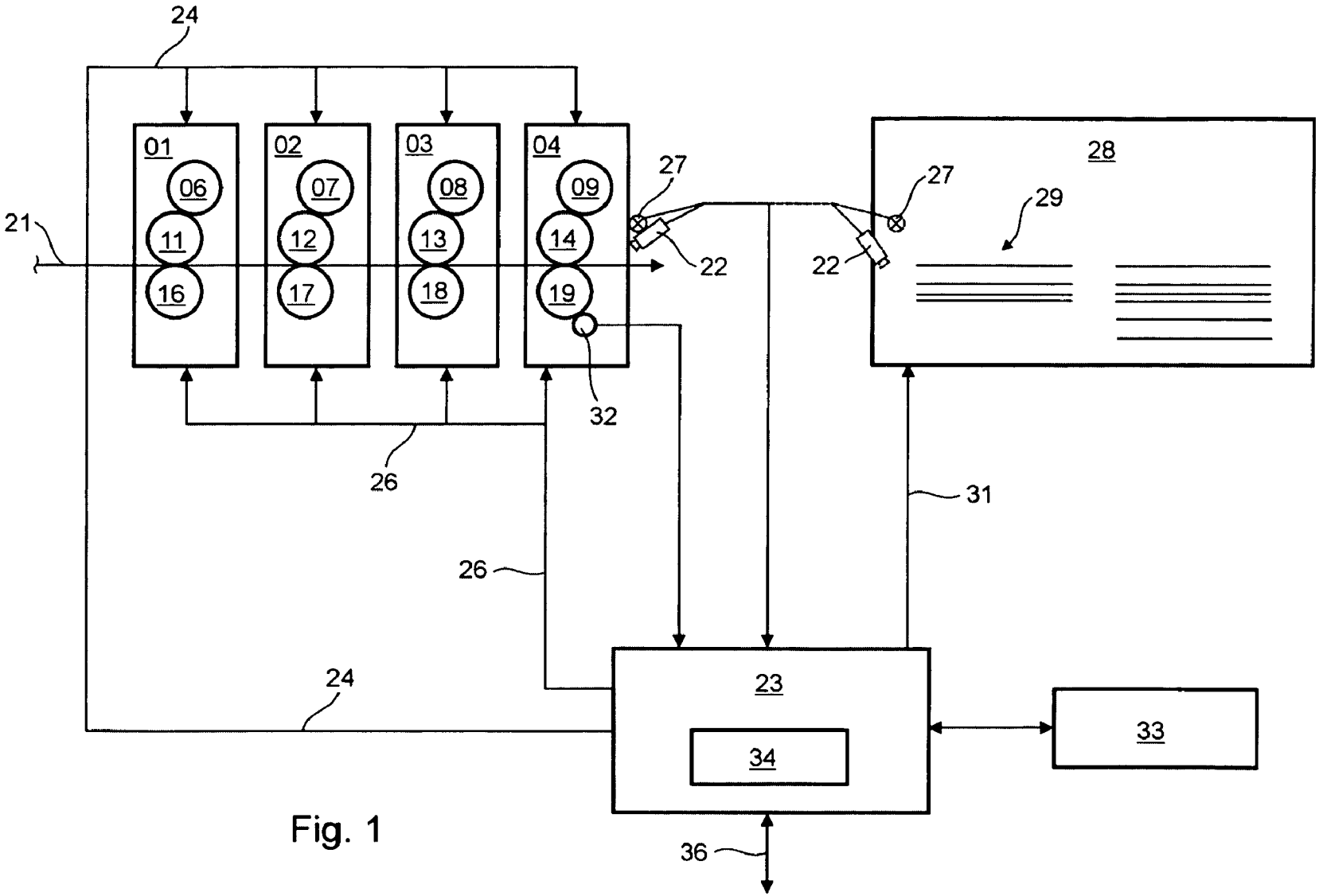
FIG. 1, a schematic representation of four aligned printing attachments of a rotary offset printing press, in FIG. 2, a schematic representation of a printing attachment for waterless offset printing, in FIG. 3, a graphical depiction of functional connection between the production speed of the printing press and a temperature to be set at a shell face of a rotating body conducting printing ink, in FIG. 4, a graphical depiction of functional connection between the production speed of the printing press and an amount of printing ink to be conveyed by a screen roller, in FIG. 5, a schematic representation of different circuits of temperature-regulating media in the printing press, in FIG. 6, a depiction of a section of a display and/or input mask for use in regulating the temperature of the screen roller and forme cylinder, in FIG. 7, a depiction of a section of a display and/or input mask for use in selecting a defined color of printing ink, in FIG. 8, a schematic representation of a process for centrally making temperature-regulating media available and supplying them in a decentralized fashion, in FIG. 9, a detailed representation of the supply unit in accordance with the present invention, in FIG. 10, a schematic depiction of an embodiment of the temperature regulation of a printing tower, in FIG. 11, a schematic depiction of an embodiment of a refrigeration center, in FIG. 12, a first preferred embodiment of a method and device for recovering heat, and in FIG. 13, a second preferred embodiment of a method and device for recovering heat.

In a schematic representation, FIG. 1 shows, by way of example, four lined-up or aligned printing attachments 01, 02, 03, 04 of a rotary offset printing press, each with a forme cylinder 06, 07, 08, 09, a transfer cylinder 11, 12, 13, 14, and a counter-pressure cylinder 16, 17, 18, 19. To form printed products, which are imprinted on both sides of a web 21, each counter-pressure cylinder 16, 17, 18, 19 is preferably also embodied as a transfer cylinder 16, 17, 18, 19, which, in turn, works together with a forme cylinder that is not specifically depicted and that is assigned to it. A printing support 21, such as, for example, a printed sheet 21 or a web 21 of material, and preferably a paper web 21, is passed between the respective transfer cylinder 11, 12, 13, 14, and the cooperating counter-pressure cylinder 16, 17, 18, 19 during production and is imprinted with at least one printed image. It is of no consequence, with respect to the subject invention, whether the printing attachments 01, 02, 03, 04 are arranged in such a way that the printing support 21 is conducted horizontally or vertically through the printing press.

An image sensor 22, such as, for example, a color camera 22, and preferably a digital semiconductor camera 22 with at least one CCD chip, can be arranged in the printing press, preferably at the outlet of the last printing attachment 04 of this printing press, in the transport direction of the printing support 21, and with its image-taking area preferably directed immediately and directly onto the printing support 21. The image-taking area of the image sensor 22 typically covers an entire width of the image support 21. This width of the printing support 21 extends transversely to its transport direction through the printing press. Thus the image sensor 22 takes an image which can be electronically evaluated of, for example, the entire width of the imprinted paper web 21. At least one printed image has been applied to the printing support 21 along the width of the paper web 21. The image sensor 22 may be configured, for example, as an area-scanning camera 22.

The image sensor 22 transfers the data correlated with the recorded image of the paper web or printing support 21 to a suitable evaluating unit 23, and in particular to, a program-controlled electronic computing arrangement 23 which, for example, is arranged in a control console, which control console is a part of the printing press. Parameters relevant to the printing process can be controlled by an analysis and an evaluation performed in the evaluating unit 23 and, in case it is required, these parameters can be corrected automatically, so to speak, i.e. program-controlled, by programs running in the evaluating unit 23. In this case, the evaluation and the correction of all of the parameters which are relevant to the printing process occurs practically simultaneously by operation of the same evaluating unit 23. In particular, the image recorded by the image sensor 22, in the course of a running production of the printing press and which is conveyed to the evaluating unit 23 in the form of a data set, is evaluated to determine whether the printed image, which has been actually recorded by the image sensor 22 and evaluated in the evaluating unit 23 shows a tone change, in comparison to a previously recorded and evaluated printed image, and in particular shows an increased tone value. In other words, an actually recorded picture is tested for comparison with a reference picture, in the course of the ongoing printing process. If the result of the check is an increase in tone value that, as a rule, is an increase in the tone value, which is technically unavoidable, the metering-in and/or the supply of printing ink in the printing press is changed by at least one first actuating command emanating from the evaluating unit 23. The at least one first actuating command is conducted through a data line 24 and acts on at least one of the printing attachments 01, 02, 03, 04 to the effect that the tone change becomes minimal by an application of printing ink following the actually checked image. After the regulation of the color density, which is performed by the change in metering and/or the supply of printing ink, the color impression of an image following the actually checked image again better corresponds to a previously checked image of a printed image, or to the reference image. The control and regulation of the tone value change is important for keeping the color balance, or grey balance, and therefore for keeping the color impression of the created printed products, as constant as possible during the printing process, and if needed, within permissible tolerance limits, which maintenance constitutes an important quality characteristic of the printed products.

In the same way, the data set, which was generated from recording the printed image and which was transmitted to the evaluating unit 23, is employed for checking the holding of the registration of a printed image applied to the printing support 21, and in particular is used for checking and, if needed, for correcting a color register of a printed image imprinted in multi-color print. At least one, preferably mechanically adjustable register is provided in the printing press, such as, for example, a circumferential register or a lateral register, or if required, even a diagonal adjustment, and is provided for at least one forme cylinder 06, 07, 08, 09, with respect to the respective transfer cylinder 11, 12, 13, 14 assigned to it. As a function of this check, the register is regulated by at least one second actuating command emanating from the evaluating unit 23, which command is conducted over the data line 26 and acting on at least one of the printing attachments 01, 02, 03, 04. The effect is that the highest possible registration accuracy results for a printed image following the recording of the evaluated image. Thus, the setting or the changing of the registers is calculated by the evaluating unit 23 from the image data that is made available to the evaluating unit 23 by the image sensor 22. By setting or changing the lateral register, it is also possible to counteract a transverse stretching which is caused by the fan-out effect. This transverse stretching occurs, in particular, in printing presses having a so-called construction-in-eight of their printing attachments.

Preferably, the printing press is configured to be shaft-free. In such a printing press, the forme cylinders 06, 07, 08, 09 preferably have individual drive mechanisms, which individual drive motors are mechanically decoupled from drive mechanisms of the counter-pressure cylinders 16, 17, 18, 19. The phase relation, or the angular position of the forme cylinders 06, 07, 08, 09, with respect to the counter-pressure cylinders 16, 17, 18, 19, can be changed by an appropriate control or regulation, preferably of the drive mechanisms of the forme cylinders 06, 07, 08, 09, whenever an evaluation of the recorded image on the printing support 21, by the use of the image sensor 22, makes this phase relation change appear necessary. The entire image content, not only individual, locally limited image elements of the printing support 21 such as, for example, reference markers or the like, therefore affects the control or the regulation of the printing attachment 01, 02, 03, 04, and in particular the drive mechanisms of the forme cylinders 06, 07, 08, 09.

An actuating command, which is generated by the evaluating unit 23 from the image content of the printed image, acts on a control device or a regulating device of a preferably position-regulated electric motor for the rotational driving during printing of at least one of the forme cylinders 06, 07, 08, 09, the transfer cylinder 11, 12, 13, 14 assigned to it, or the counter-pressure cylinder 16, 17, 18, 19. In this way, in at least one of the printing attachments 01, 02, 03, 04 of the printing press, the driving of the forme cylinder 06, 07, 08, 09 in particular, or of the transfer cylinder 11, 12, 13, 14, which is assigned to this forme cylinder 06, 07, 08, 09, is controllable or can be regulated, preferably by electrical signals. Such control or regulation is independent of the driving of the forme cylinder 06, 07, 08, 09 or of the transfer cylinder 11, 12, 13, 14, which is assigned to this forme cylinder 06, 07, 08, 09, in another printing attachment 01, 02, 03, 04 of the printing press. In particular, the mutual angular position or phase relationship of the forme cylinders 06, 07, 08, 09, or their assigned transfer cylinders 11, 12, 13, 14 which are involved in the printing of the printed product, i.e. the printed image, and which are arranged in different printing attachments 01, 02, 03, 04 of the printing press, can be set to a registration suitable for the formation of the printed product by use of the associated control device or the regulating device, such as, for example, the evaluating unit 23. The electrical motor of the forme cylinder 06, 07, 08, 09 is preferably arranged coaxially to the shaft of the forme cylinder 06, 07, 08, 09. The the rotor of the motor is typically rigidly connected with a journal of the shaft of the forme cylinder 06, 07, 08, 09 in a way such as is described, for example, in DE 43 22 744 A1. The counter-pressure cylinders 16, 17, 18, 19, which are arranged in different printing attachments 01, 02, 03, 04 of the printing press, can be mechanically connected with each other by a train of gear wheels, as described in EP 0 812 683 A1, for example, and have, for example, a common drive mechanism. However, the forme cylinder 06, 07, 08, 09, or the assigned transfer cylinder 11, 12, 13, 14, remain decoupled, with regard to their drive mechanism, from the respective counter-pressure cylinder 11, 12, 13, 14 that is assigned to each of them. A coupling, for example by the use of gear wheels meshing with each other, can exist between the forme cylinder 06, 07, 08, 09 and the transfer cylinder 11, 12, 13, 14 assigned to it, so that the forme cylinder 06, 07, 08, 09 and the transfer cylinder 11, 12, 13, 14 assigned to it are driven by the same drive mechanism. The control device or the regulating device of the drive mechanisms of at least the forme cylinders 06, 07, 08, 09 is integrated, for example, in the evaluation unit 23.

The control or the regulation of the phase relationship, or the angular position, of the forme cylinders 06, 07, 08, 09, with regard to the counter-pressure cylinders 16, 17, 18, 19, takes place with respect to a fixed reference setting. The forme cylinder 06, 07, 08, 09 can have a leading or a retarded rotation with respect to the counter-pressure cylinder 16, 17, 18, 19 which is assigned to it. The relation of the rotations of the forme cylinder 06, 07, 08, 09 and of the counter-pressure cylinder 16, 17, 18, 19 which is assigned to it, is set as a function of the image content of the image that is recorded by the image sensor 22, and is also updated by the control device or the regulating device of their drive mechanisms. It is possible, in the same way, to control or to regulate the phase relationship or the angular position of forme cylinders 06, 07, 08, 09 arranged downstream of each other in the printing process, with respect to a fixed reference setting. This is of importance, in particular during the multi-color printing of a printed matter which is imprinted in accordance with the color on forme cylinders 06, 07, 08, 09 that are arranged downstream of each other. If it is determined from the recorded image, which preferably is made up in several colors, that there is a requirement for correction of a printing color that has been printed by one of the printing attachments 01, 02, 03, 04, the evaluating unit 23 issues its actuating command, which command counteracts the detected interfering effect, and which is directed to the respective printing attachment 01, 02, 03, 04.

If the actuating drives, which are to be regulated by the evaluating unit 23, by the use of actuating commands, such as, for example, the actuating drives for regulating the feeding of printing ink, as well as the drive mechanisms for regulating the circumferential register or the lateral register, are connected in the printing press with a data net or network, which is in connection with the evaluating unit 23, the data lines 24, 26, which are provided for transmitting the first and the second actuating command are preferably realized by the data net.

Checking for a tone value change occurring in the printing process, and testing for maintaining registration are advantageously performed simultaneously in the evaluating unit 23 by parallel data processing. Preferably, these two tests are continuously performed in the ongoing printing process, namely advantageously both at the end of the printing process, and also for each individually formed printed copy.

Testing for maintaining of registration initially relates to a congruent agreement in the position of the printed image or of the printing area between recto and verso prints, or between the front or reverse side, when forming printed products that are imprinted on both sides. However, checking also includes, for example, checking the registration, such as checking the intended accuracy which the several individual partial colors have when printed on top of each other in multi-color printing. Accuracy of the registration, as well as accuracy of the color overlay, play an important role in multi-color printing.

An illumination device 27, such as, for example, a photoflash lamp 27, is advantageously assigned to the image sensor 22. Brief flashes of light emanating from the photoflash lamp 27 make rapidly occurring movement processes, as represented by the printing process, appear to be standing still, by a stroboscopic method, and in this way make them observable by the human eye. In connection with a sheet-printing press in particular, the recording of the printed image, which is performed by the image sensor 22, can also take place in, or at a depositing device 28 of the printing press, which is represented in FIG. 1, by a dashed representation of the image sensor 22 and the associated illumination device 27 as a possible option instead of recording the printed image downstream of the last printing attachment 04 of the printed page concerned, or at the end of the printing press. By an appropriate selection of the image sensor 22 and, if required, and also the appropriate selection of the associated illumination device 27, it is possible to expand the recording of the image to a visually not recognizable range, such as for example the infrared or ultraviolet range, or to displace the image in that range. As an alternative to the preferred area-scanning camera 22 with the photoflash lamp 27, the employment of a line camera with permanent illumination is also possible.

Since preferably every printed copy is subjected to a check, it is possible, in connection with the ongoing printing process, i.e. during a production run, to detect a trend toward tone value changes, as well as to maintain registration of successively formed printed copies. Depending on the value of their tone and/or of their inherent registration, as determined during the ongoing printing process, the printed copies can be classified into groups of different quality stages. When a permissible tolerance limit has been exceeded, the printed copies in that group can be marked as waste copies. Waste copies can be removed in a controlled manner by the evaluating unit 23 or, in particular in connection with a sheet-fed printing press, can be deposited onto a separate deposit stack 29 in the depositing device 28. For this purpose, at least one third actuating command, which is conducted via a data line 31, and being, for example, a waste signal, is sent from the evaluating unit 23, which evaluates the printed image, to at least one actuating drive for sorting the flow of copies, which at least one actuating drive acts on at least one arrangement for transporting the printing support 21.

To synchronize the frequency with which recording of the images on the printing support 21 takes place, with the transport speed of the printing support 21, or with the speed of the paper web 21, for example, an angle encoder 32 has been installed in at least one of the printing attachments 01, 02, 03, 04, and preferably in that printing attachment 01, 02, 03, 04, in or at which the recording of the images, by the image sensor 22, takes place. The operating angle encoder 32 is in a fixed relationship with the rpm of that transfer cylinder 11, 12, 13, 14 at which the image sensor 22 records the images. The angle encoder 32 provides its output signal to the evaluating unit 23 and/or to the image sensor 22. The output signal from the angle encoder 32 is utilized, among other things, as a trigger for the photoflash lamp 27.

The image recorded by the image sensor 22, and sent to the evaluating unit 23 in the form of a data set, is preferably displayed on the monitor on an input and output unit 33, which is connected with, and which performs a bidirectional data exchange with the evaluating unit 23. The input and output unit 33 simultaneously provides possibilities for correction for at least one of the previously mentioned regulating devices by making possible manual input and/or triggering of an actuating command.

The evaluating unit 23 has a memory 34 for, in addition to other tasks, storing recorded image sequences, as well as for storing data that is useful for logging and, along with it, for documenting the quality of the printed products, as well as for statistical analyses regarding the printing process. It is advantageous if the evaluating unit 23 can make the data evaluated and/or stored in it available to a company network via an appropriate connector 36.

For a comparison, as performed by the evaluating unit 23, of data which are correlated with an image actually recorded in the course of the ongoing production by the printing press, with data of a previously recorded image, the data of the previously recorded image can correlate with an image recorded in a pre-printing stage that is arranged upstream of the printing press. A data processing device of the pre-printing stage, which is not specifically represented is connected with the evaluating unit 23 and sends the data of the previously generated image to the evaluating unit 23. In the process, data from the previously generated image are generated alternatively, or additionally, to the data which correlate with an image that is recorded by the image sensor 22, and is made available to the evaluating unit 23 for evaluation. In contrast to data obtained from images previously printed in the course of ongoing production, data correlated with the printed image, and obtained from the pre-printing stage, provide more accurate reference data for use in controlling or regulating the color register.

A register regulation and a color regulation is possible, in the printing press depicted schematically in FIG. 1, on the basis of an analysis of the same picture of the printed image recorded by the image sensor 22. The picture of the printed image is evaluated in a single evaluating unit 23 with regard to different parameters which are relevant for the printing process, as well as simultaneously for an inspection of the printed image for use in judging the quality of the printed matter.

In this case a, registration measurement in the printed image is the basis of the registration regulation. After all of the printing colors, which are required for the printed image, have been printed, the entire printed image is recorded by the camera, preferably at the end of the printing press. A separation of the printed image takes place in the evaluating unit 23, where the image is preferably separated into the color separations CMYK which are customary in printing technology. An analysis of suitable printed image sections and a relative position determination of a color separation, in relation to a reference color separation, by correlation processes with a previously recorded or obtained printed reference image is also accomplished.

The reference image, or the reference value, of an image section or of a printed image marker, and specifically the desired density value is obtained, for example, from the pre-printing stage. This has the advantage that the reference image is already present in the respective color separations. Alternatively, a reference image, such as, for example, a reference sheet with a printout of the printed image, is used for the evaluation and is taken from an imprint of the printed image. The reference image additionally must be divided into the color separations. This reference sheet is recorded, after the printed image has been manually set once in such a way that all printed printing colors are correctly positioned with respect to each other and therefore a correct color register has been set. The printed reference image, which is obtained in this manner, can be stored for later repeat orders, so that recourse can be had to this previously taken reference image in the case of a repeat order. The color register can also be set automatically by the evaluating unit 23 without manual interference which, in the case of a repeat order, leads to a further reduction of waste.

Characteristic and suitable sections are selected from the printed reference image, by the use of which characteristic sections, the position of the individual color separations, with respect to the reference color separation, is determined. This is a so-called desired position for later register comparison. This reference image, including the color separations and the desired position, is stored, for example, in the memory 34. The selection of suitable printed image sections can be done manually by the operator or can take place automatically by the evaluating unit 23, for example for the presetting of the desired position. Areas in which the printing color to be measured dominates, or occurs exclusive, are suitable printed image sections with respect to register measuring.

During the ongoing printing process, such as during a production run, every printed image is recorded by the camera system and is split into the color separations CMYK. Now, the position of the individual color separations within the previously determined suitable printed image sections is determined. This occurs by a comparison of these color separations with the color separations from the printed reference image, for example by a correlation method, and in particular by a cross-correlation method. The position of the color separations can be fixed within approximately 0.1 pixels in the camera resolution by the correlation method. If a stationary register offset is repeatedly determined for each printed sheet 21, a high degree of accuracy of the measured value is assured by suppressing stochastic scatter.

The determination of the position of the individual color representations takes place in the running direction of the web in accordance with the linear register, and in a transverse direction to the web running direction in accordance with the lateral register. The position differences which are obtained in this manner, are converted into actuating commands in the evaluating unit 23 and are transmitted as correction signals to the displacement section, or, in other words, to the drive mechanisms.

In offset printing, special colors are not mixed with the standard colors, typically the graduated colors CMYK, but instead are separately printed. Therefore, special colors are also separately measured. First, the areas in which special colors are printed must be defined. Now, their own suitable areas are defined for each one of the special colors, in which the position of the color separations is determined in the same way as for the graduated colors CMYK, which are the standard colors. Further procedures for register regulation, in connection with special colors, are identical to the procedures previously described for standard colors.

An advantageous embodiment of the present invention will be described in what follows, in which the regulation of the color ink supply is performed on the basis of detected data regarding the color density and/or the spectral analysis by a temperature, which is used as a command variable, and which temperature can be set on the shell face of the rotating bodies that are participating in the printing process. In this case, the recording of the data can take place over the entire web width, or over the imprinting width, or only over one or several printed image sections, or over special markers that are applied to the material to be imprinted. The color density corresponds to a layer thickness of colored printing ink which is applied to the material to be imprinted and can be detected, for example, by densitometry. This detection can be done in line, during the ongoing printing process, as well as off line, such as by a measurement on printed copies removed from the ongoing printing process.

Figure 2:
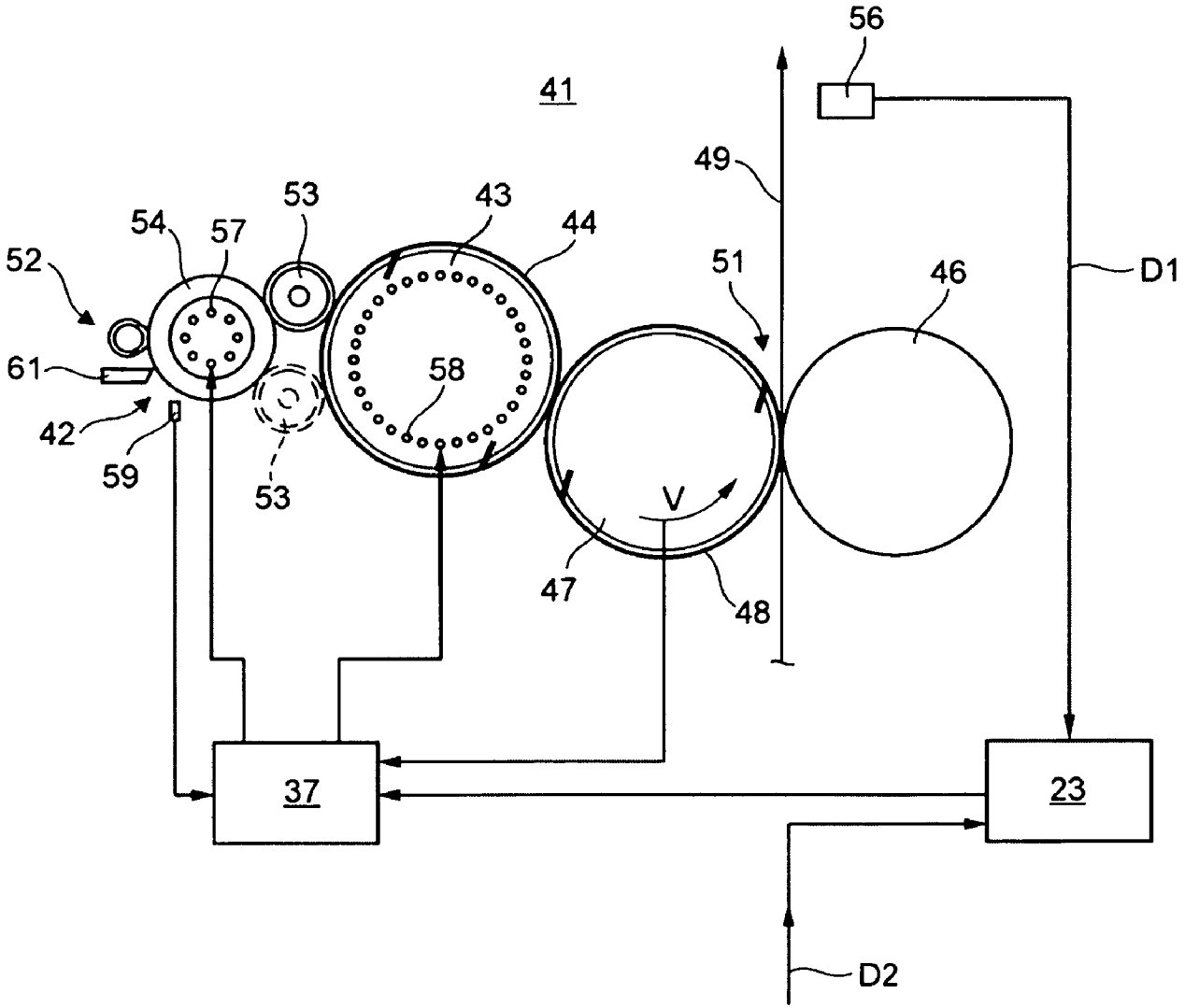

As FIG. 2 depicts, an adjusting device 37 is provided, which is supplied with a signal with data from the evaluating unit 23. For example, as a function of the deviation of an actually recorded color density D1 from a color density D2 preset as a desired value, by the use of at least one temperature-regulating device 57, 58, a change is made in the temperature set by the adjusting device 37 on the shell face of at least one of the rotating bodies 43, 47, 53, 54 participating in the printing process, such as, for example, the cylinders 43, 47, or the rollers 53, 54. In the interest of a rapid, systematic, and therefore reproducible change, it is possible to store a functional connection between the deviations in the color densities D1 and D2 and the temperature to be set, such as, for example, in a memory 34 that is located upstream of the adjusting device 37 or the evaluating unit 23. This functional connection is fixed in place, for example in at least one characteristic line, table or other, suitable form representing the correlation, for example graphically or electronically.

Figure 5:
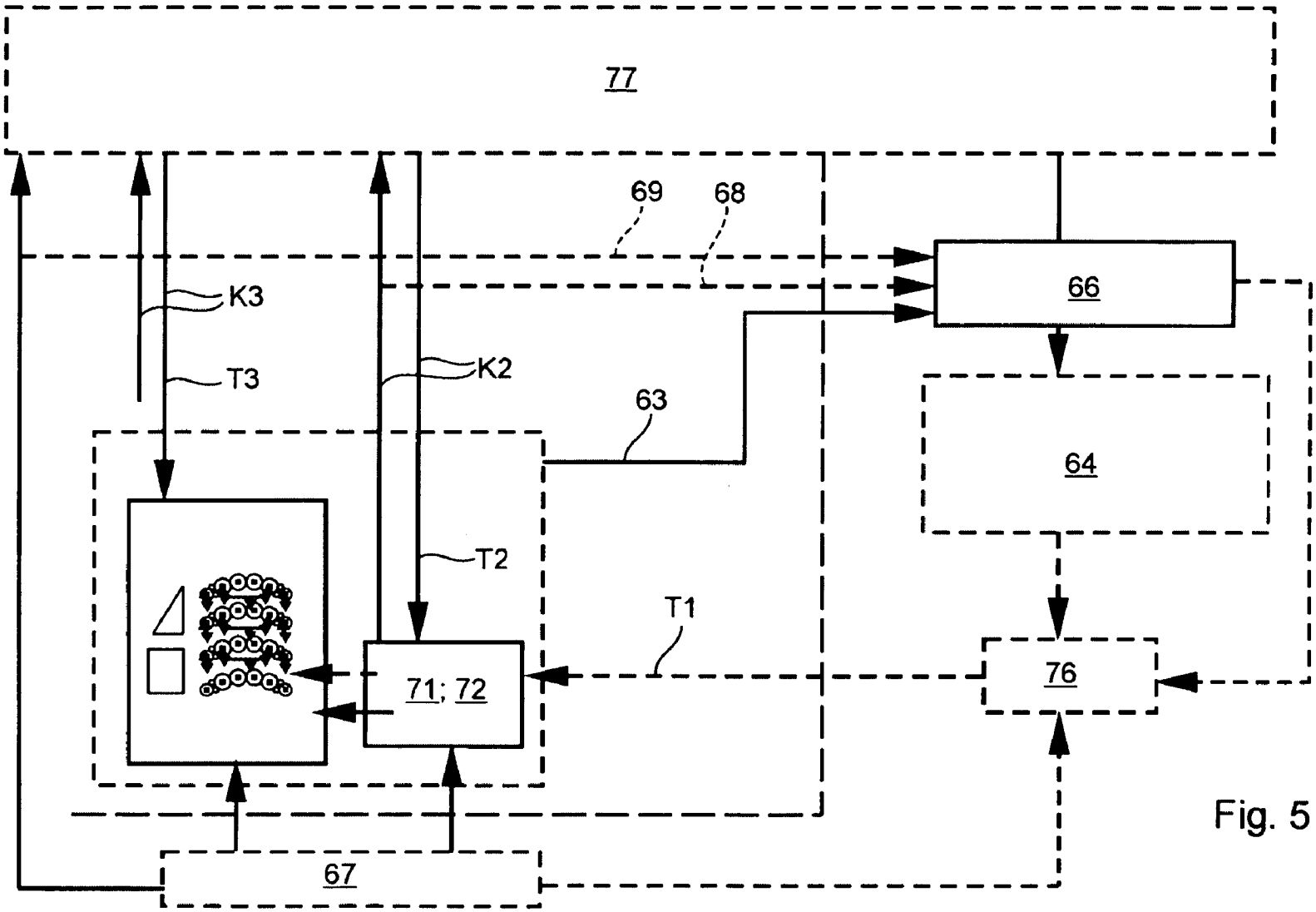

The adjusting device 37, including the arrows, represented in FIG. 2, here representatively stands for, or depicts, the action paths of the control, or regulation. No distinction was made here between signal paths and supply paths. The adjusting device 37 can have a control or regulating device 72, for example an electronic control arrangement 72, and/or a supply arrangement 71, as depicted in FIG. 5, for metering and for feeding temperature-regulating media. Please refer to FIGS. 8 to 11 in this connection. Then, the electronic control arrangement 72 acts on actuating members, such as, for example, valves of the supply arrangement 71, for example, in accordance with a specification that is determined by a stored logic.

The printing press represented in FIG. 2, by way of example, is configured as a rotary printing press, in particular, and has a printing attachment 41, which has at least one inking system 42, a cylinder 43 supporting a printing forme 44, such as, for example, a printing attachment cylinder 43 configured as a forme cylinder 43, as well as a counter-pressure cylinder 46. The attainment described in what follows is particularly advantageous in connection with printing presses, or in printing press modes of operation, with a web speed of more than 10 m/s, and in particular with a web speed that is greater than or is at least equal to 12 m/s. Preferably, the printing forme 44 is configured as a printing forme 44 for planographic printing, or a planographic printing forme 44, and in particular a printing forme 44 for waterless planographic printing, or a waterless planographic printing form 44. The printing attachment 41 is, for example, embodied as a printing attachment 41 for offset printing and has, between the forme cylinder 43 and the counter-pressure cylinder 46, a further cylinder 47, such as, for example, a printing attachment cylinder 47 embodied as a transfer cylinder 47 with a dressing 48 on its shell face. Together with the counter-pressure cylinder 46, the transfer cylinder 47 forms a print location 51 for a material 49 to be imprinted, such as, for example, a web 49 of material to be imprinted. The counter-pressure cylinder 46 can be a further transfer cylinder 46 of a further, non-identified printing attachment, or a counter-pressure cylinder 46 which does not convey printing ink, such as, for example, a steel or a satellite cylinder.

The printing forme 44 can be embodied to be sleeve-shaped, or can be embodied as one, or as several printing plates 44, which has or have been fastened or suspended with its ends in at least one narrow channel, whose width in the circumferential direction does not exceed 3 mm, indicated schematically in FIG. 2. In the same way, the dressing 48 on the transfer cylinder 47 can be embodied to be sleeve-shaped or as at least one rubber blanket 48, which is also fastened and/or clamped in at least one channel. If the rubber blanket 48 is embodied as a multi-layered metal printing blanket, the channel is also embodied at the above mentioned maximum width.

The inking system 42 has an ink supply device 52, such as, for example, an ink trough with a dipping roller or a lifter, or a doctor blade with an ink feed, as well as at least one roller 53, which can be placed against the forme cylinder 43 in a print-on position, for example an application roller 53. In the example represented in FIG. 2, the printing ink is transported from the ink supply device 52 via a roller 54 which is embodied as a screen roller 54, to the roller 53, then to the forme cylinder 43 and to the transfer cylinder 47 and from there to the material 49 to be imprinted, which material is provided, for example, in the shape of a web or of a sheet. It is also possible to provide a second application roller 53, shown in dashed lines in FIG. 2, which acts together with the screen roller 54 and the forme cylinder 43. The screen roller 54 has depressions, or small cups, in its shell surface for dipping printing ink out of a reservoir 61 for printing ink, for example out of an ink duct 61 containing ink, and to transfer it to an adjoining rotating body 53, for example an application roller 53.

The printing attachment 41 is configured as a so-called "printing attachment for waterless planographic printing", and in particular is a printing attachment for "waterless offset printing, commonly called dry offset", printing such that no supply of a dampening agent for forming "non-printing" areas is required at the printing attachment, in addition to supplying printing ink. In this method of printing, the application of a film of moisture on the printing forme 44 can be omitted, which film of moisture otherwise, in connection with the so- called "wet offset method", prevents the non-printing portions on the printing forme 44 from absorbing printing ink. In waterless offset printing, this non-absorption of ink is achieved by the use of special printing inks and the special embodiment of the surface of the printing forme 44. For example, in waterless offset printing, a silicone layer can take over the role of the hydrophobic area of the plate used in the wet offset method, which silicone layer can be coated with a dampening agent and can prevent the printing forme 44 from picking up ink.

In general, the non-printing areas and the printing areas of the printing forme 44 are achieved by the formation of areas of different surface tension and of different interaction with the printing ink.

To accomplish printing that is free of scumming or printing, without the non-printing areas also absorbing printing ink and possibly even becoming clogged, a printing ink is needed whose tackiness, as measured as the ink tack value, has been set in such a way that a perfect separation can take place on the surface because of the difference in surface tension between printing and non-printing portions of the printing forme. Since the non-printing locations are preferably embodied in the form of a silicone coating, a printing ink is required for this purpose, which has clearly greater tackiness, in comparison with the ink used in wet offset printing.

Tackiness represents the resistance with which the printing ink counteracts film-splitting in a roller gap, or splitting in the course of transferring the printing ink between the cylinder and the material to be imprinted.

Since ink tackiness changes with the temperature, in actual use the cylinders 43, 47, or the inking system 42, are temperature-regulated during the operation of the printing press, and in particular are cooled, and are kept at a constant temperature in order to prevent such scumming from occurring under changing operating conditions during printing.

The temperature dependency of rheological properties, such as, for example, viscosity and/or tackiness, is now employed for affecting, and in particular for regulating, the amount of ink to be transported from the ink reservoir 61 to the material 49 to be imprinted. In place of, or in addition to mechanical actuating members, such as, for example, the opening or closing of doctor blades, or a change in the speed of lifters or film rollers, it is now possible to affect the result of the comparison of the desired color density D2 with the recorded color density D1 by a change of the temperature at the shell face of at least one of the rotating bodies 43, 47, 53, 54 participating in the printing process.

Besides the separation of printing and non-printing areas, however, the tackiness of the printing ink also affects the intensity of plucking which occurs when an ink-conducting cylinder 43, 47 acts together with the material 49 to be imprinted. In particular, if the material 49 to be imprinted is embodied as uncoated, only lightly compressed newsprint with very good absorbency, or in other words with open pores and with a very low ink absorption time, the danger of the release of fibers or dust, as caused by plucking, is increased. This danger also exists, for example, in connection with slightly coated or with lightweight coated paper or the types typically employed in web-fed offset printing, such as papers having a coating weight of, for example, 5 to 20 g/m$^2$, and in particular 5 to 10 g/m$^2$, or even less. As a whole, temperature regulation is suitable, in particular, for uncoated or for coated paper of a coating weight of less than 20 g/m$^2$. For coated paper, the temperature regulation of the ink-conducting cylinders 43, 47 is advantageous in those cases in which it has been determined that the coating is "pulled off" or is at least partially pulled off the paper because of increasing tackiness.

In order to keep plucking of the material 49 to be imprinted, or to keep a build-up of printing ink on the dressing 48 of the transfer cylinder 47, and/or on the printing forme 44 of the forme cylinder 43, as low as possible, an attempt is made to manufacture and to employ the printing ink in accordance with the type of use and the expected operating conditions in such a way that the printing ink is utilized as closely as possible to the lower limit of its tackiness.

In a further embodiment of the present invention, it is possible to simultaneously regulate the temperature of one or of several of the ink-conducting components such as, in an advantageous embodiment for example to regulate the temperature of the printing attachment cylinders 43, embodied as forme cylinders 43, as the ink-conducting component 43, or/and the printing ink itself, as a function of the production speed V of the printing press. For this purpose, a signal, which is correlated with the production speed V of the printing press, is picked up, for example at the ink-conducting transfer cylinder 47, by the use of a sensor, such as, for example, provided as an angle encoder, which is not specifically represented. This signal is supplied to the adjusting device 37 and/or the evaluating unit 23. Here, the temperature at the shell face of at least one of the rotating bodies 43, 47, 53, 54 participating in the printing process, and preferably the shell face of the forme cylinder 43, is not kept constant within a defined temperature range for all production speeds V, as otherwise customary in waterless offset printing, but has a different desired temperature $T_{i,soll}$ for different production speeds V. The desired temperature $T_{i,soll}$ is set by operation of the adjusting device 37, as a function of the production speed V in such a way that the tackiness of the printing ink lies within a predeterminable window of tolerable tackiness values at each desired production speed V. An increased value of the desired temperature $T_{i,soll}$ of the respective component 43, or of the printing ink, is selected for a higher production speed V.

A regulation of the temperature is based, for example, on the principle that a definite value, or a maximum value, of the desired temperature $T_{i,soll}$ of the component 43, or of the printing ink, is provided as the initial value of the intended, the immediately imminent, or the actually set production speed V, as the command variable which is based on a systematic assignment. In both cases, the desired value, or the maximum value, represents a predetermined temperature which, in the first case, corresponds to a temperature which is to be maintained, and which, in the second case, corresponds to an upper limit of a permissible temperature. However, by the detection of the color density D1 of the color actually applied to the material 49 to be imprinted, which detection is performed, preferably in line, by the use of a photo-electric sensor 56, and preferably by an image sensor 56, and in particular by a CCD camera 56, and the comparison of this detected value with the desired value of the color density D2 intended for this printing, the temperature is varied and updated until a sufficient agreement between the actual color density D1 and the desired color density D2 has been achieved.

If other conditions should prevail, such as, for example, a printing ink with substantially different properties, and in particular regarding its consistency, or a material 49 to be imprinted having a surface structure deviating from uncoated newsprint and/or having a completely different plucking behavior, the values of the connections can considerably differ from the above-mentioned values. However, the setting of the temperature of the forme cylinder 43, as a function of the production speed V, is still common to the attainment, namely in such a way that, in a range of higher production speeds V, the temperature has a higher desired value, or a higher maximum value, than would be the situation in a range of lower production speeds V. By this, plucking between the ink-conducting cylinder 43, 47 and the material 49 to be imprinted is reduced and, in the ideal case, is almost prevented.

The above-mentioned connections between a detected color density and a temperature change, and/or between the temperature at the shell face of at least one of the rotating bodies 43, 47, 53, 54 involved in the printing process, and the production speed V of the printing press can be stored for different printing colors and/or for different types of material to be imprinted. In the course of the printing process, the connection which is specific for the respective printing ink and/or for the respective material 49 to be imprinted is then employed. For this connection, also refer to the portion of the subject specification in connection with the preferred embodiment of the present invention described subsequently in accordance with FIGS. 6 and 7.

In an advantageous embodiment of the present invention, the screen roller 54 and the forme cylinder 43 each have a temperature-regulating device 57, 58, which respectively acts on each cylinder's shell faces from the cylinder's interior, and through which shell face a temperature-regulating medium that is capable of flowing, for example water, flows. The temperature on the shell face of the screen roller 54 is set, and preferably is controlled or is regulated, in consideration of the amount of ink to be transferred by it. The temperature at the shell face of the forme cylinder 43 is set to avoid plucking and/or scumming, taking into account the production speed V of the printing press. Depending on the embodiment in the present case, whether the process is controlled or regulated, the adjusting device 37 is configured as a control device 37 or as a regulating device 37. In the case of the provision of the adjusting device 37 as a control device 37, there is no feedback in the process, via the photoelectric sensor 56, or the signal or data delivered by it.

To control the temperature at the shell face of the screen roller 54, such a temperature is determined, typically empirically, for example, in the previous stage of production, for a pairing, or pairings of interest, for printing color/paper at various production speeds V, at which the desired color density can be detected on the product. In connection with the regulation of the temperature at the shell face of the screen roller 54, it is possible to detect the actually set shell face temperature with the aid of at least one thermal sensor 59 which is arranged at, or near, the shell face of the screen roller 54. An output signal from thermal sensor 59 can be provided to the adjusting device 37 and then, as a function of a comparison between the actual temperature and a desired temperature executed in the adjusting unit 37, the actual temperature of the shell face of the screen roller can be reset, if required, and in this way can be updated to convey the amount of ink which is required for the printed image.

Parallel with the control/regulation of the temperature at the shell face of the screen roller 54, the temperature at the shell face of the forme cylinder 43 is also controlled or regulated, as a function of the production speed V. If necessary, this temperature is additionally controlled as a function of the material 49 to be imprinted and/or as a function of the printing ink. The regulation of the temperature at the shell face of the forme cylinder 43 by using a further thermal sensor, which is not specifically represented, is similar to that used for regulating the temperature at the shell face of the screen roller 54. However, preferably the temperature is not additionally varied by the result of the evaluating unit 23, but is fixedly correlated with the production speed V of the printing press.

It is advantageous, if a temperature to be set for a value of the production speed V of the printing press at the shell face of the roller 54, and in particular at the face of the screen roller 54 and/or the cylinder 43, and in particular at the forme cylinder 43, is set, or the setting this required temperature is at least started before the new value of the production speed V of the printing press is set. The setting of the temperature, in view of an intended change of the production speed V, takes place in advance. By this pre-setting, it is possible to avoid an error which otherwise occurs systematically, because it is possible, by a chronologically advanced adaptation of the temperature setting, to clearly reduce the amount of produced waste because of an incorrect temperature setting. Adaption of the temperature setting typically reacts more slowly, and thus, with a longer reaction time, until stable operating conditions have been reached, than is the case with the change of the production speed V which is performed, for example, by electronically controlled or regulated drive mechanisms. Thus, an intended change in the production speed V which, for example, is displayed by an appropriate, such as, for example, manual, input at the input and output unit 33, which input and output unit 33 is a part of the evaluating unit 23, can be delayed, for example by program technology, in its execution by the evaluating unit 23. This change in production speed V can be delayed until the temperature-regulating device 57, 58 has reached, completely or at least to a significant amount of clearly more than 50%, preferably more than 80%, in particular above 90%, the temperature which is required for the new production speed V and is to be set at the shell face of the screen roller 54 and/or of the forme cylinder 43.

In regard to the screen roller 54 alone, or to the printing press as a whole, the previously described measures are also suitable for providing that the temperature to be set at the shell face of the screen roller 54 is set, or can at least be set, as a function of the production speed V of the printing press. A capability, which is reduced by an increase of the production speed V of the printing press, of the depressions formed in the shell face of the screen roller 54 to accomplish the transfer of printing ink to the rotating body 53 adjoining the screen roller 54, is compensated for by a reduction of the viscosity of the printing ink which is achieved by the set temperature. With an increasing production speed V of the printing press, the depressions or the small cups at the shell face of the screen roller, and which are filled with printing ink, are increasingly less completely emptied. The worsening transfer behavior of the screen roller 54 can be compensated for by a matching liquefaction of the printing ink to be transferred. The reduction in the viscosity of the printing ink advantageously takes place by the temperature to be set at the shell face of the screen roller 54.

In a further preferred embodiment of the present invention, the temperature-regulating device 57, 58 is embodied in such a way that the temperature at the shell face of the roller 54, and in particular at the shell face of the screen roller 54, and/or the cylinder 43, and in particular of the forme cylinder 43, which temperature has been set by the use of the adjusting device 37 assigned to this temperature-regulating device 57, 58 on the basis of a predetermined functional assignment to a value of the production speed V of the printing press, can be changed within predetermined limits, such as, for example, by the use of a manually performed setting. Because of this, an intervention option, with regard to mechanically predetermined settings, is provided. A manually performed fine setting can be set, as required, within a maximally permissible tolerance range, which is defined by threshold values, of for example +/−5% or 10% with respect to the preset value. The threshold values can be spaced apart symmetrically or unsymmetrically from the preset value. For example, they can also define a tolerance range between −5% and +10%.

Figure 3:
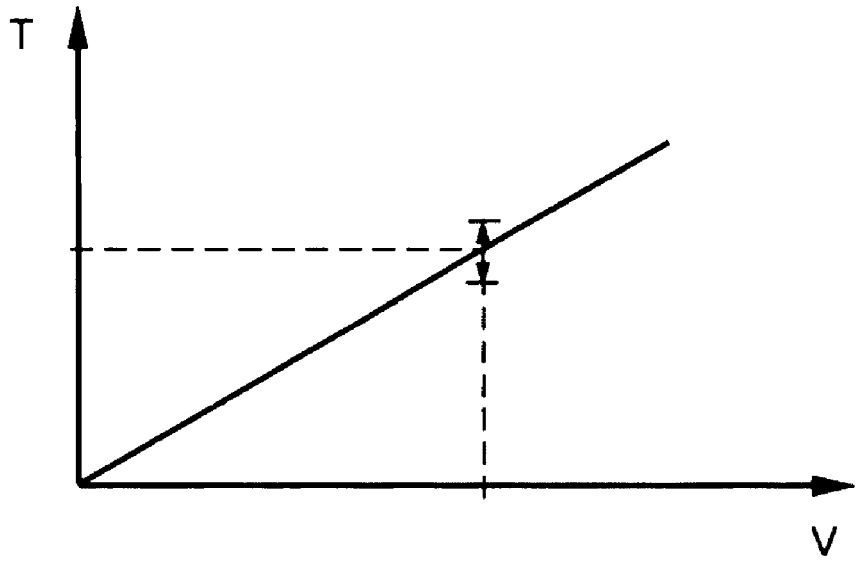
Figure 6:
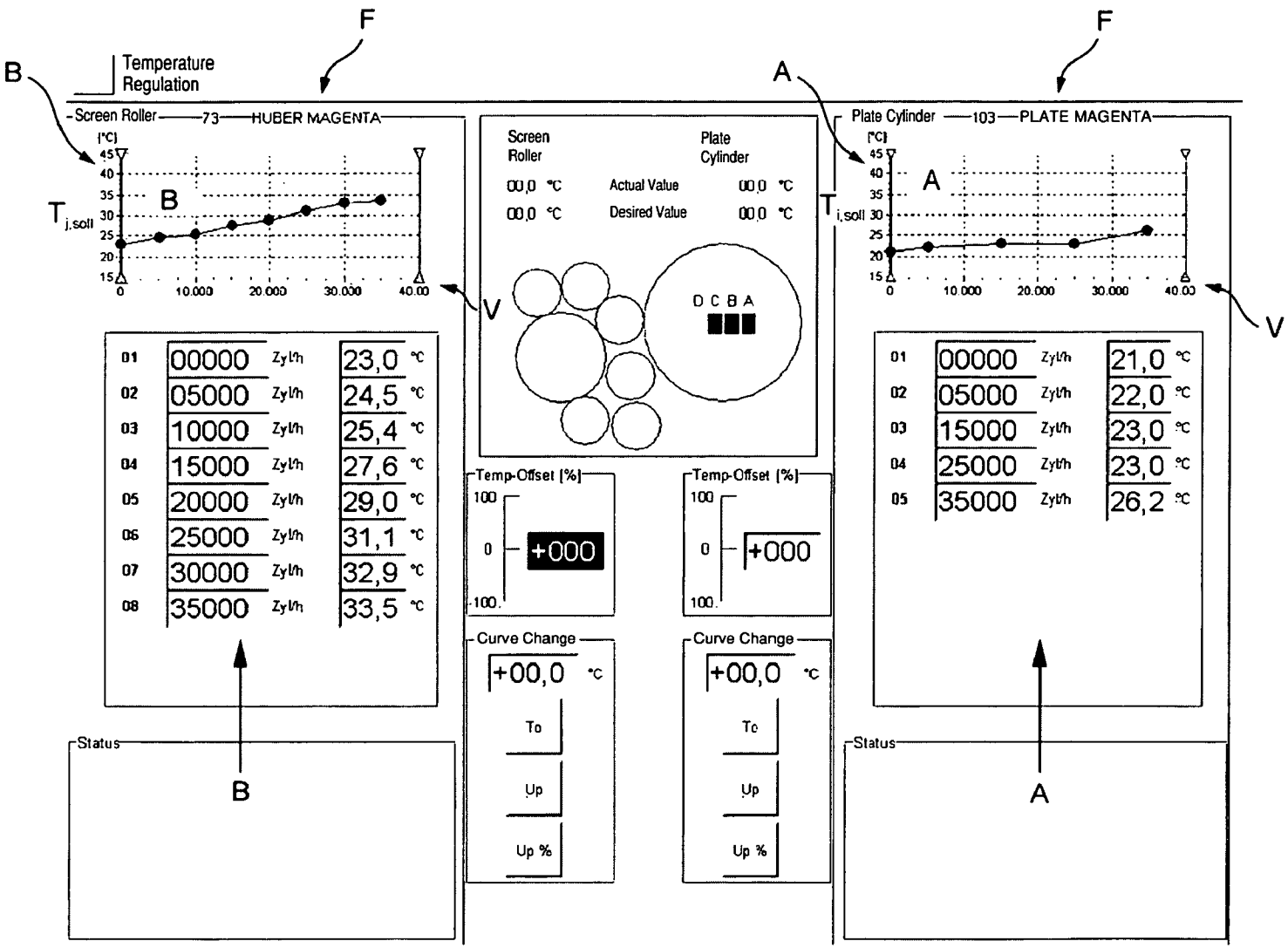

FIG. 3 schematically shows a functional connection, such as, for example, the dependency B illustrated in FIG. 6 as to how a desired temperature $T_{i,soll}$ at the shell face of at least one of the rotating bodies 43, 47, 53, 54 taking part in the printing process can be a function of the production speed V of the printing press. The functional connection can be linear, but can also be non-linear. In every case, a suitable value of the desired temperature $T_{i,soll}$ to be set on the shell face of at least one of the rotating bodies 43, 47, 53, 54 can be determined by the use of the functional connection for one printing process fixed, inter alia, by the printing ink used and the material 49 to be imprinted used as a function of the production speed V of the printing press. The mechanically determined value of the desired temperature $T_{i,soll}$ to be set on the shell face of at least one of the rotating bodies 43, 47, 53, 54 can be manually adjusted in the sense of a fine adjustment, for example, within predetermined limits, which has been indicated in FIG. 3 by a vertical two-headed arrow which is enclosed in limiting lines.

Figure 4:
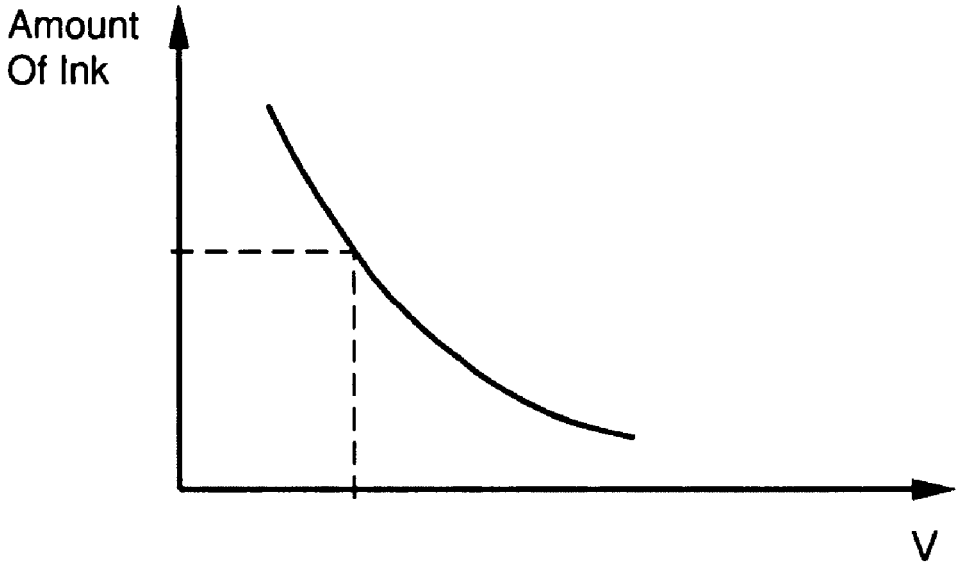

FIG. 4 also shows, by way of example, a functional relationship of an amount of ink which is conveyed by the screen roller 54, as a function of the production speed V of the printing press. The viscosity of the printing ink to be conveyed can be changed, in particular by adapting the temperature at the shell face of the screen roller 54 in such a way that the conveying rate remains at least approximately constant in case of a change of the production speed V of the printing press. This can take place, in particular, via a stored connection, depicted as the dependency A in FIG. 6 between the production speed V and a desired temperature $T_{i,soll}$. However, alternatively or additionally to its dependency on the production speed V of the printing press, the conveying speed of the screen roller 54, in particular, can be made a function of a detected deviation of the actually recorded color density D1 from the color density D2 which had been preset as the desired value.

The index "I" or "j" of the desired temperature $T_{i,soll}$ or $T_{j,soll}$ is to indicate that this temperature can relate to a multitude of stored dependencies A, B for different components 43, 54, or for different color types F and/or for different types of paper. A large amount of different dependencies A, B is stored in the memory unit 34 of the respective adjusting device 37, at least for the respective desired temperature $T_{i,soll}$ or $T_{j,soll}$ of the screen roller 54 and the forme cylinder 43, which dependencies can be accessed by use of the input and output unit 33 of, for example, the adjusting device 37.

Figure 7:
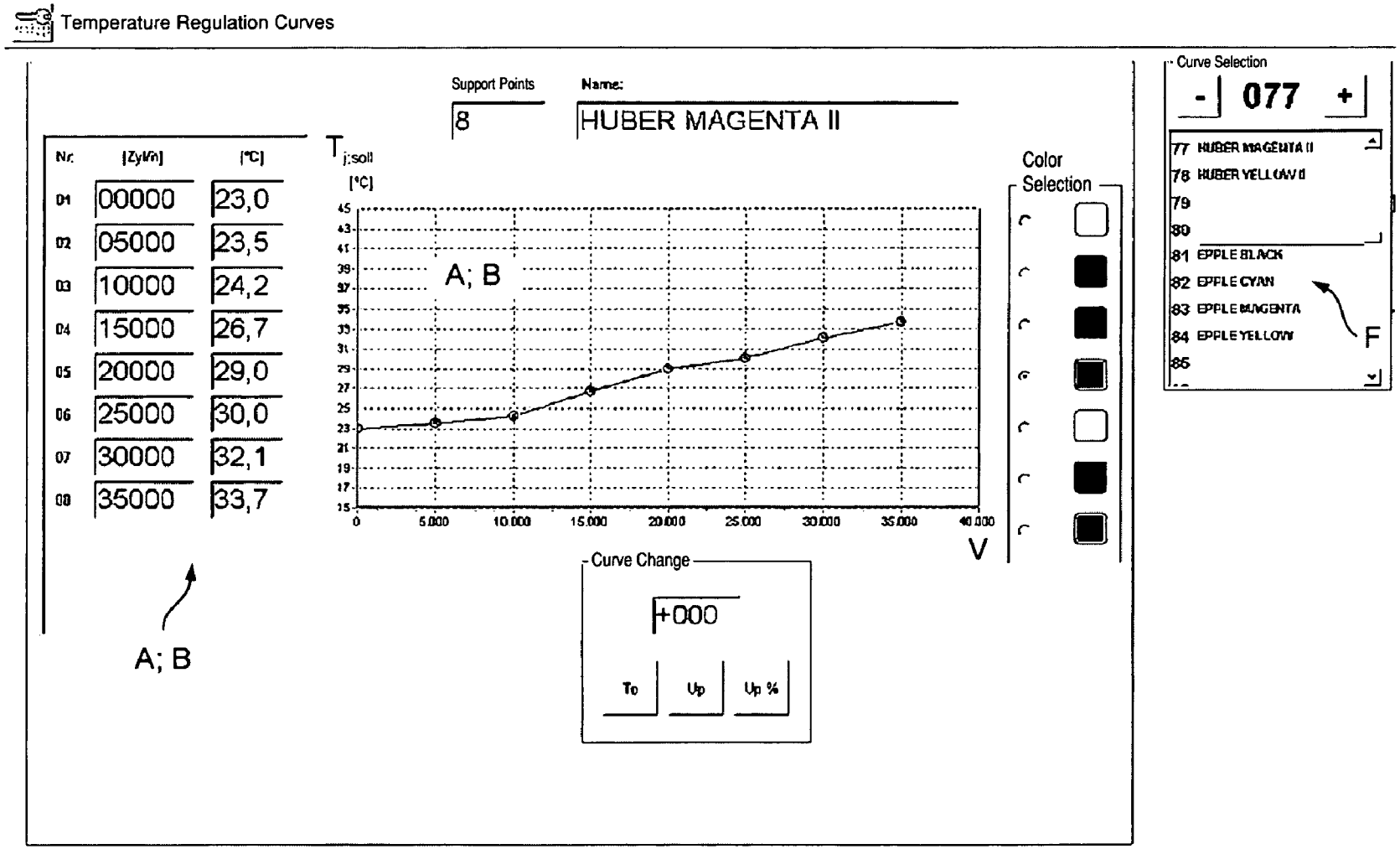

FIGS. 6 and 7 represent a preferred embodiment for a temperature regulation in a display or an input mask. A specification of the desired temperature $T_{i,soll}$, $T_{j,soll}$ of the components 43, 53 whose temperature is to be regulated, here the screen roller 54 and the forme cylinder 43, is shown as a dependence A for the forme cylinder 43 and as a dependable B for the screen roller 53 from the production speed V. Color specific curves regarding different printing inks, or color types, analytically, or regarding support points, in the form of tables for the connection between the desired temperatures $T_{i,soll}$, $T_{j,soll}$ of the respective components 43, 53 and the production speed V, are stored in a memory unit 34, such as, for example, a data bank of the control console, the adjusting device 37 or the evaluating device 23. As can be seen in FIG. 6, individual dependencies A, B, depicted as curves or tables have been provided for the temperature-regulation of the screen roller 54 and the forme cylinder 43, respectively. The curves represented in FIG. 6 are based on support points which are stored in the memory unit 34, and in particular in a data bank of the memory unit 34, for a defined dial-up or a selected color type F, depicted here as "HUBER MAGENTA" by way of example. The selection of the color type F, and therefore the dependence, can take place for the screen roller 54 and/or the forme cylinder 43 from a list, for example by the use of a mask or of a menu corresponding to FIG. 7. In the selection of a printing color, or of a color type F, the stored dependence A, B, such as, for example, a curve and/or the stored support points, is uploaded and is employed as the basis for setting the temperature-regulation of this component 43, 54. The curves, or support points, can preferably be changed by the operators for providing an adaptation and thereafter can be stored, changed in this way, in the memory unit 34.

A required target temperature or desired temperature $T_{i,soll}$ $T_{j,soll}$ of the component 43, 54 to be temperature-regulated is defined by the use of this stored dependence A, B, or of the connections, for the existing production speed V. This is output as a specified value for the desired temperature $T_{i,soll}$, $T_{j,soll}$, and is converted, for example by the use of a supply arrangement 71 with an electronic control device 72, in a manner to be explained in greater detail below.

An embodiment of the present invention is advantageous, in accordance with which a stored dependence A, B, in the form of a curve and/or as a series of support points, can be corrected by the operators, absolutely as a whole, or relatively upward or downward. This is expressed in FIG. 6, for the forme cylinder 43 and the screen roller 54 respectively, for example by use of the input field "Temp.Offset" and the input field "curve change". By the use of this, the dependence A, B for the dialed-up color type F can be retained, in principle. However an adaptation to specific printing density requirements and/or an adaptation to the requirements of different materials to be imprinted can be made manually, by an input of the display and/or input mask, shown in FIGS. 6 and 7 displayed on the monitor of the input and output unit 33. In the variation "Temp.Offset", however, the stored and displayed dependence itself is not changed. Only the desired value, resulting for the subsequent control circuit, is correspondingly charged with the change. Thus, the stored dependence A, B, or the curve, basically remain. The change only has an effect on the dialed-up printing attachment. In a second variation "curve change", the dependence, such as the curve, or a series of support points can be changed per se. This can take place by the addition of a constant, either raising or lowering of the entirety, and/or percentage-wise, either spreading or compressing.

In the present example, target or desired temperatures $T_{i,soll}$ for the forme cylinder 43, in connection with production speeds V of 5,000 cylinder revolutions/hour, preferably lie between 20 and 24° C., and at 35,000 cylinder revolutions/hour these temperatures lie between 24 and 28° C. For the screen roller 54, target or desired temperatures $T_{i,soll}$, in connection with production speeds V of 5,000 cylinder revolutions/hour, lie between 22 and 27° C., and at 35,000 cylinder revolutions/hour they lie between 31 and 36° C.

Figure 8:
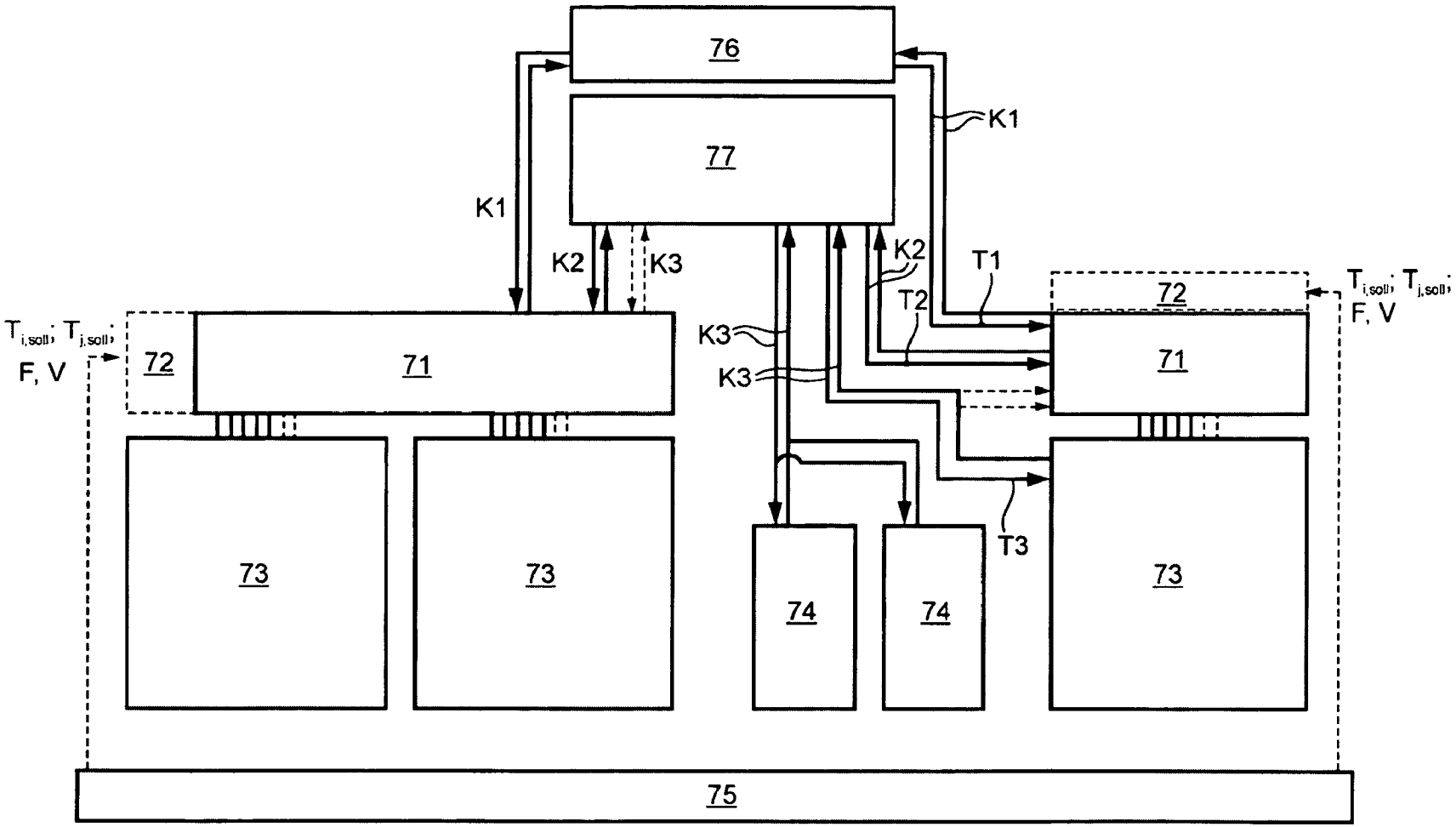

It can be understood from FIG. 8 that it is possible to provide several circuits, which are separated from each other, for temperature regulation. In particular, a supply circuit K2, such as, for example, a supply circuit K2 for at least one of the printing attachment cylinders 43, 47 and/or for the screen roller 54, as well as a further supply circuit K3, for example a supply circuit K3, for example for the drive mechanisms M of the printing attachment cylinders 43, 47 and/or of the screen roller, and/or, if desired, for regulators assigned to these drive mechanisms M as components M to be temperature-regulated can be provided.

The temperature-regulating medium, which substantially consists of water, with or without additives, is made available for the temperature regulation of the printing attachment cylinders 43, 47 and/or of the screen roller 54 by a cooling arrangement 77, for example a refrigeration center 77, in a temperature range between 10° C. and 25° C. The temperature-regulating medium for the temperature regulation of the drive mechanisms M of the printing attachment cylinders 43, 47 and/or the screen roller 54 is made available from the refrigeration center in a temperature range between 24° C. and 30° C. As explained in greater detail below, this refrigeration center 77 can have an air-cooled condenser and/or an independent cooling device and/or a cooling booster device for peak output at higher ambient temperatures, such as, for example, in summer, and/or a heat exchanger for heat recovery, and/or a compressor refrigeration machine. As explained below, it preferably has at least two of these cooling arrangements 77.

By the use of heat recovery, by, for example, an arrangement 66 for heat recovery as described for example in connection with FIGS. 12 and 13, it is possible to recover 5 to 10% of the cooling output of the cooling processes 87, for example, as will be discussed below. This recovered energy can be employed for internal use, for example for regulating the temperature in a building, for the preparation of hot water, for humidifying the air in a building, for pre-warming fresh air and/or as a partial energy source for a hot water reservoir 76, as depicted in FIGS. 5 and 8. As schematically represented in FIG. 5, a heat-recovery device 66 can recover the heat flow of different sources, such as, for example, of the heat flow 68 and 69, indicated by the return flow of the supply circuit K3 and/or K2, or of the heat flow 63, as indicated by the ambient air heated in the area of the printing units, or of the heated product flow. The temperature regulation of the components 43, 54, in particular by the use of the temperature-regulating medium and of the heat recovery, results in that the printing press emits only a comparatively small amount of waste heat to the ambient air and/or to the flow of copies of the printed products produced on it. Energy, which is fed to the printing press from energy sources 67, and in particular electrical energy in the amount of, for example, several kVA, is utilized at a high degree of efficiency.

The hot water reservoir 76 may have a capacity of, for example, approximately 1 $m^3$ per printing tower 73, as will be discussed below and, at the start-up of the printing press, provides the temperature-regulating device 57, 58 of the printing attachment cylinders 43, 47 and/or the screen roller 64 with the stored temperature-regulating medium for a comparatively short time of, such as, for example, for 3 to 4 minutes, at a temperature T1, of for example between 50° C. and 70° C. The stored temperature-regulating medium is usable for setting the temperature at the shell face of the printing attachment cylinders 43, 47 and/or the screen roller 54 to at least 50° C., for example 55° C., at least during the time of start-up of the printing press. The printing press is brought to its operating temperature in a short time period because of the elevated temperature T1 of the temperature-regulating medium from the hot water reservoir 76, which has a beneficial effect on the quality of the printed products produced during start-up of the printing press. The output of waste printed products is reduced by this start-up heat supply.

The following discussion regarding the control of the temperature regulation and the supply with temperature-regulating medium are particularly advantageous in connection with one or with several of the previously mentioned embodiment characteristics, such as, for example, with the control circuit for the color density in connection with the evaluating unit 23, and/or with the temperature regulation of the screen roller 54 as a function of the speed, and/or with the temperature regulation of the forme cylinder 43 as a function of the speed. Reference is made to what was said before in regard to details.

In accordance with the depiction shown in FIG. 8, the supply with temperature-regulating medium of the components 43, 54 takes place via decentralized supply arrangements 71 which, together with an on-site electronic control device 72, constitute a decentralized adjusting device 37 for one or several printing attachments 41. The adjusting device 37, or the supply arrangement 71, is assigned to a group of printing attachments 41, which together form at least one printing unit 73. The printing unit 73 constitutes the group of all printing attachments 41 assigned to a web to be imprinted and/or constitutes a printing tower 73. A first section with a printing tower 73 and a folding apparatus 74 is represented on the right side of FIG. 8 On the left side of FIG. 8 is shown a second section with two printing towers 73 and an associated folding apparatus 74. The supply arrangement 71 can be assigned to one or to several adjoining printing towers 73 of a section. Supply lines and control valves, which will be described in greater detail below, exist in this supply arrangement 71, for the definite supply of the components 43, 54 to be temperature-regulated, with the required temperature-regulating medium at the suitable temperature level.

From a higher order control device 75, such as, for example, a logic device, which is implemented in the machine control or in a control console computer, the supply arrangement 71, or the assigned electronic control device 72, receives the above mentioned target or desired temperatures $T_{i,soll}$ directly after they had been determined, as described there, by the use of stored dependencies A, B. The electronic control device 72 is at least provided with data regarding the color type F and/or the production speed V, which allows a logic device implemented in the electronic control device 72 to determine the target or desired temperature $T_{i,soll}$ on the basis of dependencies stored there.

Figure 9:
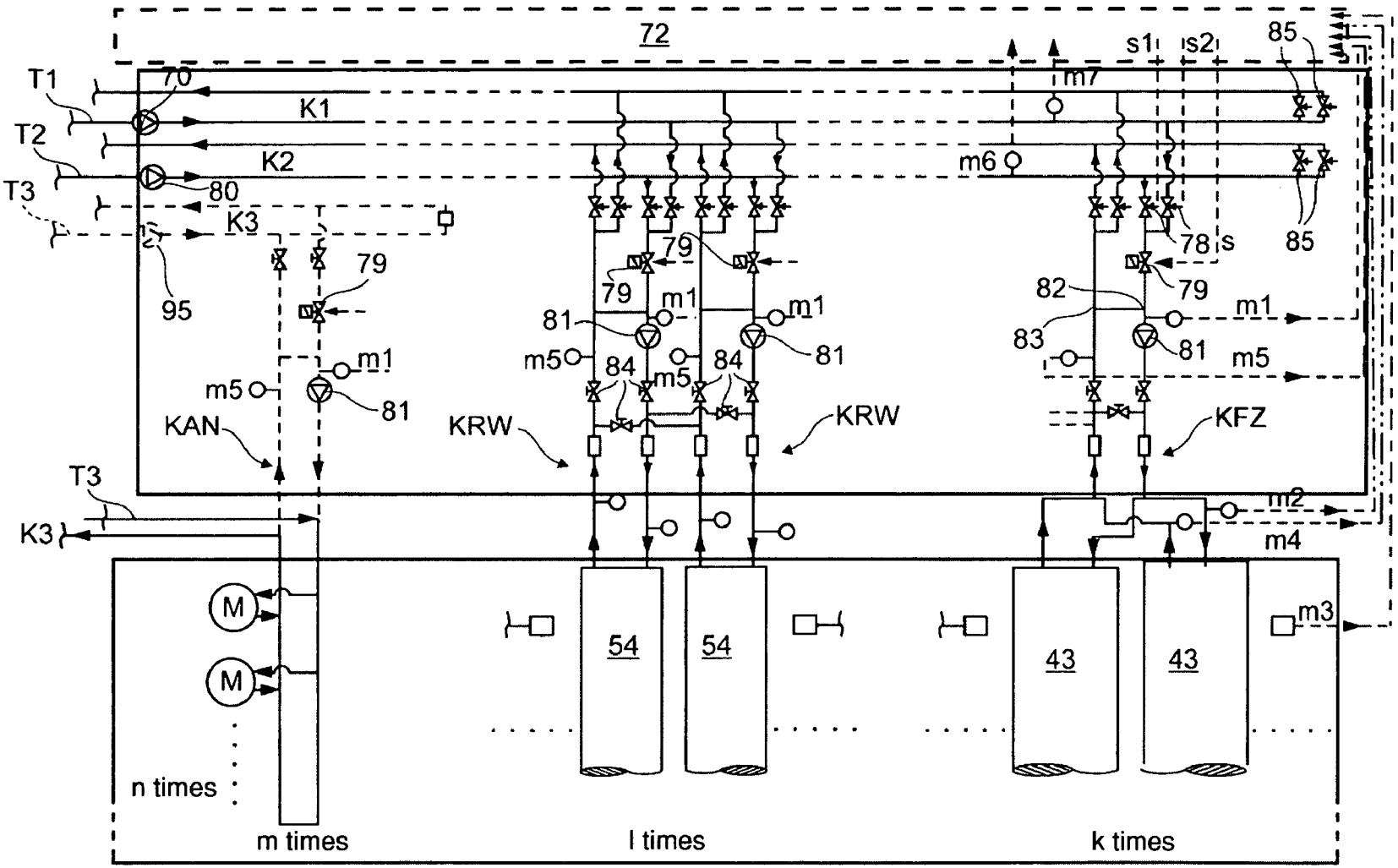

The supply units 71, which are arranged in the printing press installation close to the printing tower, are now connected with a first supply circuit K1, for example circuit K1, which provides the supply unit 71 with temperature-regulating medium at a first temperature level T1 above the ambient temperature, purely for heating purposes. This temperature-regulating medium can either be heated as required, such as can take place in a flow heater, for example. However, an appropriately temperature-regulated supply is advantageously already stored in a reservoir 76, such as, for example, a temperature-regulating medium reservoir 76, or a heating fluid reservoir 76, and in particular in a hot water reservoir 76. The energy supply for this, or its heating, will not be discussed in detail here. This can take place by utilization of customary heating installations, with or without waste heat utilization from the printing press. In an advantageous embodiment, with waste heat utilization it is possible to provide at least a portion of the heating energy for the reservoir 76, such as, for example, by the use of a heat-recovery device 66, and in particular by a heat-recovery device 66, for example, according to, or similar to FIG. 13, with a heat pump 121. A pump 70, as seen in FIG. 9, which transports the temperature-regulating medium in the circuit K3, can be advantageously provided in a branch circuit of the circuit K3, or instead can be provided in the area of the hot water reservoir 76.

The supply unit 71 is furthermore connected to a second circuit K2 which, for temperature-regulating purposes, provides the supply unit 71 with temperature-regulating medium of a second temperature level T2 which, depending on the actual requirements, can lie, in principle, in a range of, for example, between 5° C. and 30° C., and advantageously in a range of between 8 to 25° C., and in particular in a range of between 10 to 15° C. Depending on the demands made on the desired component temperature, more or less temperature-regulating medium from this supply circuit K2 is then admixed to a temperature-regulating circuit KFZ, KRW, as will be discussed below, which regulates the temperature of the component 43, 54. To make the temperature-regulating medium available, a cooling arrangement 77, such as, for example, a refrigeration center 77, has at least one appropriate cooling process, also temperature-regulating medium source, but preferably has two cooling processes, temperature-regulating medium source, which are energetically different. However, advantageously the temperature-regulating medium at this level can come, directly or indirectly dependent from the level of the external temperature or from the temperature level T2 requested by the printing press, from the cooling processes which are different in respect to each other, or from the temperature-regulating medium sources of the cooling arrangement 77 or, as a rule, from a specific mixture of temperature-regulating media from the two cooling processes which differ from each other in energetic respect, as is discussed below. Details regarding the manner in which this is made available by a cooling arrangement 77 will be provided subsequently in connection with FIG. 11. A pump 80, which is usable for transporting the temperature-regulating medium in the circuit K2, can be advantageously provided in a branch circuit of the circuit K2 in the supply unit 71, and also in the cooling arrangement 77.

In an embodiment which is represented in dashed lines in the central portion of FIG. 8, a third circuit K3 is provided, which is also supplied by the cooling arrangement 77. For this supply circuit K3, the cooling arrangement 77 supplies a temperature-regulating medium of a "medium" temperature level T3 which, in contrast to the circuit K2, lies in a higher temperature range of, for example, 20 to 35° C., and in particular, in the range of 24 to 30° C. The requirement, or definition, of the desired temperature level T3 made on the cooling arrangement 77 is provided by a computing and/or control device 100 of the printing press to a logic unit 92, such as, for example, the control device 92 of the cooling arrangement 77, as may be seen in FIG. 11. The computing and/or control device 100 and the control device 75 can be configured as one control device, or can both be components of the same control device.

In an alternative configuration, as represented in dashed lines in FIGS. 8 and 9, the circuit K3 is connected to the decentralized supply arrangement 71, and the temperature-regulating medium is supplied to the users, as is discussed below: drive mechanisms M and/or drive regulators of the printing tower 73 not directly, as above, but through the supply arrangement 71.

FIG. 9 represents an advantageous embodiment of a decentralized supply arrangement 71, which contains at least the two supply circuits K1 and K2, as well as in one possible embodiment, as depicted in dashed lines the supply circuit K3. The supply arrangement 71 is assigned to a group of printing attachments 41, which here constitute the printing attachments 41 of a printing tower 73, such as, for example, the printing tower 73 depicted at the right in FIG. 8. For reasons of clarity, only two cylinders 43 to be temperature-regulated, such as, for example, two forme cylinders 43, as well as two rollers 54, such as, for example, two screen rollers 54, are represented, which, in the end, corresponds to two print locations, for example a double print location for simultaneous, two-sided printing by two transfer cylinders 47 that are placed against each other in a rubber-to-rubber operation.

In the advantageous embodiment represented in FIG. 9, the preparation of the temperature-regulating medium takes place in the temperature-regulating circuit KFZ, circuit KFZ for short, of the forme cylinders 43 in pairs. Two forme cylinders 43, and in particular those of a common double print location, are supplied in parallel with the prepared temperature-regulating medium. It is also basically possible, depending on the requirements, to assign a temperature-regulating circuit KFZ to each individual forme cylinder 43, or also to larger groups of, for example, four, six or eightforme cylinders 43.

Temperature regulation takes place in such a way that the temperature-regulating medium circulates, driven by the pump 81, in the temperature-regulating circuit KFZ, and, in the process, flows through the assigned component or components 43, 54 to be temperature- regulated, and in particular flows through their temperature-regulating device 57, 58. Temperature-regulating medium can be metered in at the crossing point 82 from one of the supply circuits K1 for heating purposes or from one of the supply circuits K2 for cooling purposes, and an adequate amount can be removed at the crossing point 83. Dial-up of the temperature-regulating medium to be metered in takes place via the position, either open or closed of valves 78, such as switching valves 78 which can be remotely operated, in appropriate branch lines that are connected with the supply circuits K1, K2. After bringing the branch lines together, metering of the selected temperature-regulating medium into the temperature-regulating circuit KFZ takes place by the use of a metering valve 79, and in particular by the use of one which can be driven by remote control. The metered-in amount is intermixed with the temperature-regulating medium already circulating in the temperature-regulating circuit KFZ. Rapid intermixing can be accelerated by means of a swirling chamber, which is not specifically represented, between the crossing point 82 and the pump 81.

A desired value for a temperature of the component 43, 54, which is here explained representatively for individual, or for groups of forme cylinders 43 or screen rollers 54, can, in principle, be generated in the most different ways and is now intended to be converted in the supply arrangement 71 for this component 43, 54. The specification of the target or of the desired temperature $T_{i,soll}$ of the component 43, 54 to be temperature-regulated can advantageously take place as a function of the production speed V, as explained above in connection with FIGS. 6 and 7 wherein, for example additionally, the color type F being used and/or paper type being used can also be considered. In the simplest embodiment of the control circuit, conversion now takes place in such a way that at least one measured value m2 of the temperature of the temperature-regulating medium is determined shortly before its entry into the component 43, 54. A measured value m3 for the surface temperature of the component 43, 54 itself may be determined, for example, as a measured value m3 from an infrared sensor that is directed on the surface of the water, and is compared with the respective desired value in the electronic control device 72. Depending on the deviation, temperature-regulating medium is metered in from one of the supply circuits K1 or K2 via the metering valve 79 into the circuit KFZ, or the circuit KRW, as discussed below. Dial-up of the required circuit K2, K3, temperature level T1 or T2, takes place by the use of an appropriate actuating command S1, S2 from the electronic control device 72 to the switching valves 78, such as, for example, one closed and the other open. The metering of the required injection amount takes place by the use of an actuating command S from the electronic control device 72 to the metering valve 79.

An advantageous further development of the described control circuit reacts considerably faster with a measured value ml for the temperature shortly after admixing has occurred at the crossing point 82, in particular downstream of a swirling chamber and still upstream of the pump 81, a measured value m2 of the temperature of the temperature-regulating medium shortly before entry into the component 43, 54, already in the area of the respective printing attachment 41, and/or a measured value m3, of an infrared sensor, for the surface temperature of the component 43, 54, or of the ink itself located on it, and a measured value m5 for the temperature of the temperature-regulating medium during its return flow, already in the supply arrangement 71 again upstream of the crossing point 83. In a further embodiment, it is also additionally possible to pick up a measured value m4 shortly after exiting the component 43, 54, still in the area of the respective printing attachment 41. These measured values m1 to m3 and m5, as well as possibly m4, are now processed together in a multiply cascaded control circuit, taking into consideration running time corrections and pre-control members, such as has been described in detail in WO 2004/054805 A1, the disclosure contents thereof is expressly incorporated herein by reference. With the use of the measured value m1 shortly downstream of the metering point in particular, and possibly downstream of a swirling section, but upstream of the pump 81, it has been made possible to significantly shorten the reaction time, while taking control track information into account, in contrast to a regulation which, for example, only uses the measured values m1, m4 or m5 for regulation. In the latter case, the result of an interference is only noticed very late and is taken into consideration.

Advantageously, the measured values m6 and m7 are picked up, for detecting the temperatures in the feed lines of the supply circuits K1 and K2. These are supplied to the electronic control device 72 for being taken into consideration.

The structure and effect of a temperature-regulating circuit KFZ, KRW has been described only by the example of the forme cylinder 43 in FIG. 9. However, this description should also be applied to the other temperature-regulating circuits KFZ of other forme cylinders 43, which are assigned to the supply arrangement 71, as well as to the temperature regulation of the screen rollers 54.

In the depicted example of FIG. 9, the screen rollers 54 are individually temperature-controlled by the number I of their own controllable temperature-regulating circuits KRW, circuit KRW for short, which temperature-regulating circuits KRW are connected with the two circuits K1 and K2. The background for this is that the amount of ink to be transported for each individual screen roller 54 can be set per se. For reasons of dependability, the temperature-regulating circuits KRW of two screen rollers 54 of a double print location are connected with each other by the use of bypass lines which can be closed off. Appropriate valves 84 are provided for this. If, for example, a pump 81 or a metering valve 79 in one of the two circuits KRW, which two circuits are connected with each other, fails, it is possible, following the opening and closing of appropriate valves 84, for the corresponding circuit KRW to also temporarily take over the temperature regulation of the component 43, 54 which is endangered by this failure. This is indicated by dashed lines for the circuit KFZ of the forme cylinders 43, in which case the temperature regulation of two forme cylinders 43 which are affected by the failure can be taken over by an adjacent circuit KFZ of two other forme cylinders 43.

In the case where the circuit K3 is also coupled to the supply arrangement 71, as seen in FIG. 8, it is possible to transfer the principle of admixing temperature-regulating medium from the circuit K3 into a temperature-regulating circuit KAN, circuit KAN for short, by the use of which, one or several groups of the drive mechanisms M of the printing unit 73 are temperature-regulated, as can be seen in the dashed representation of K3 in FIG. 9. In this case, the preparation is controlled, for example, by the associated metering valve 79 as a function of the measured value m1 of this circuit KAN directly downstream of the feed-in, and/or of the measured value m5 in the return flow. Since heating is not required here, the temperature-regulating circuit KAN is only connected with a supply circuit K3. Because the temperature regulation of the drive mechanisms is less critical than is the temperature regulation of the forme cylinders 43, or of the rollers 54, it is possible here to regulate the temperature of a larger number n drive mechanisms M by the use of a common circuit KAN. It can be advantageous if a number m of circuits KAN, wherein m=2, is provided, which respectively supply one half, either the left side or the right side of a printing unit 73, or of a printing tower 73, as is seen in FIG. 10.

In the two circuits K2 and K3, the respective feed and return lines are connected with each other in the area of their ends which are remote from the cooling arrangement 77 by the use of at least one bypass line, which bypass line can be opened or closed by the use of switchable valves 85. Each such valve 85 can be opened in case of a very limited removal of temperature-regulating medium by the circuits KFZ and KRW for maintaining a sufficient fluid flow and, in this way, for maintaining the storage of correctly temperature-regulated temperature correction medium in the feed line for the circuits KFZ and KRW. In this case, two or more bypass lines, for each circuit K1, K2, with valves of different flow-through cross sections, or one valve 85 for each circuit, which can be controlled in regard to the amount of flow-through, can be advantageously employed here. In this way, the circulated amount can be adjusted, and can be stepped in respect to the requirements.

A small amount of temperature-regulating medium advantageously always circulates in the circuit K2. This insures that the reaction time is as short as possible when temperature-regulating medium of a suitable temperature is needed.

Figure 10:
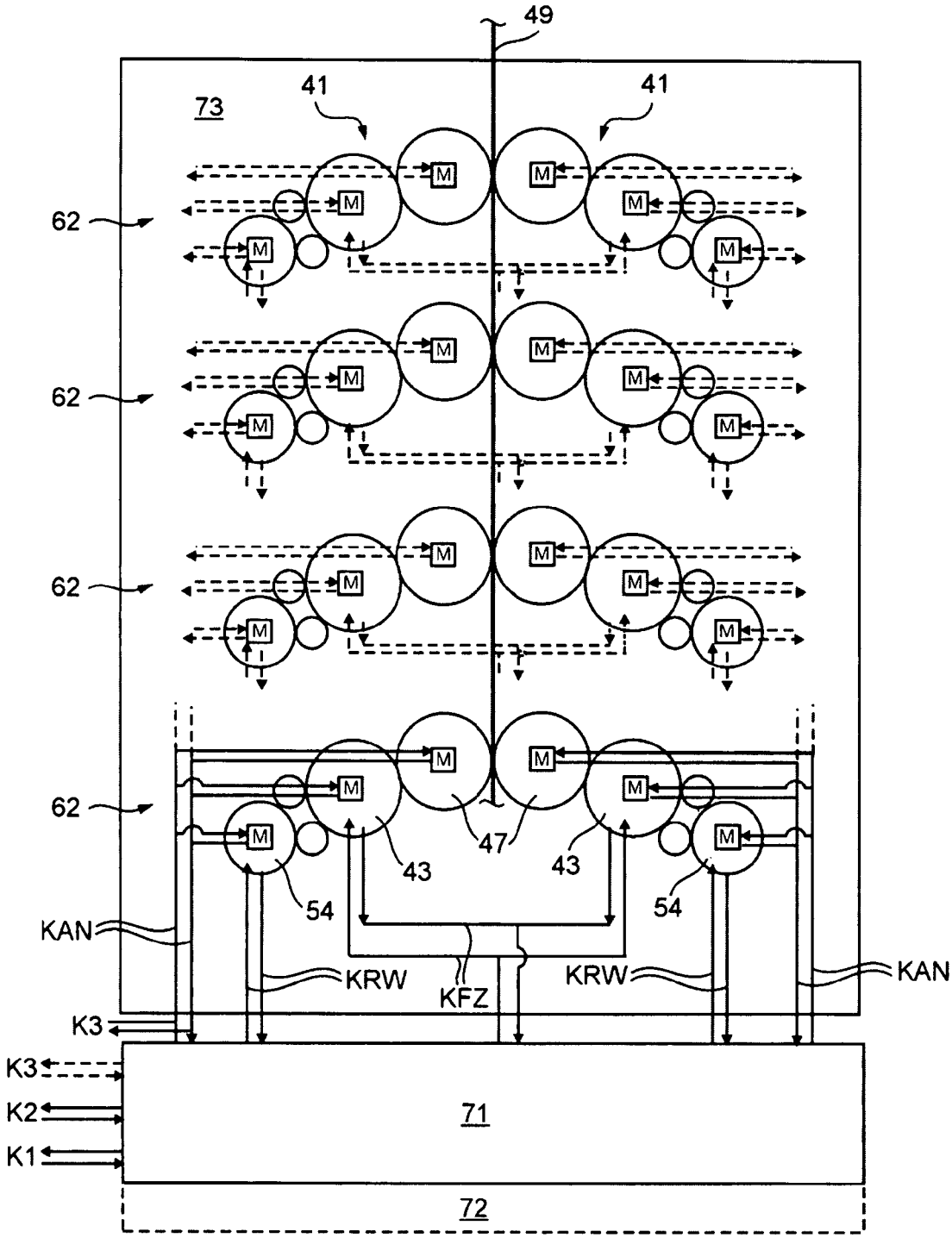

An advantageous construction of a printing tower 73 is depicted in FIG. 10, and having a number of l=8 printing attachments 41, which here constitute a number of h=i/2=4 double print locations, or double printing attachments 62, for accomplishment of the simultaneous, two-sided printing of a web 49, with two transfer cylinders 47 placed against each other in rubber-to-rubber operation. The supply arrangement 71 with its associated control, or regulating device 72 is assigned to the printing tower 73. As represented in detail only for the lowermost one of the four double printing attachments 62, each screen roller 54 of the printing tower 73 has its own circuit KRW. The forme cylinders 43, which are part of the same double printing attachment 62, have a common circuit KFZ and are thus arranged in pairs. All rotatory drive mechanisms M, and in particular, the drive mechanisms M which are mechanically independent of each other, of the screen rollers 54 and of the forme and transfer cylinders 43, 47 on the same side of the web of material 49 to be imprinted, are connected to a common circuit K3. Thus, in accordance with FIG. 9, the result, with regard to the present printing tower 73, is k=4 circuits KFZ, i=8 circuits KRW and m=2 circuits KAN. Advantageously, all of the forme cylinders and the transfer cylinders 43, 47, as well as the screen rollers 54, have individual drive mechanisms as their drive mechanisms M, which are mechanically independent of each other, so that a number of n=12 drive mechanisms M per circuit KAN are temperature-regulated.

Figure 11:
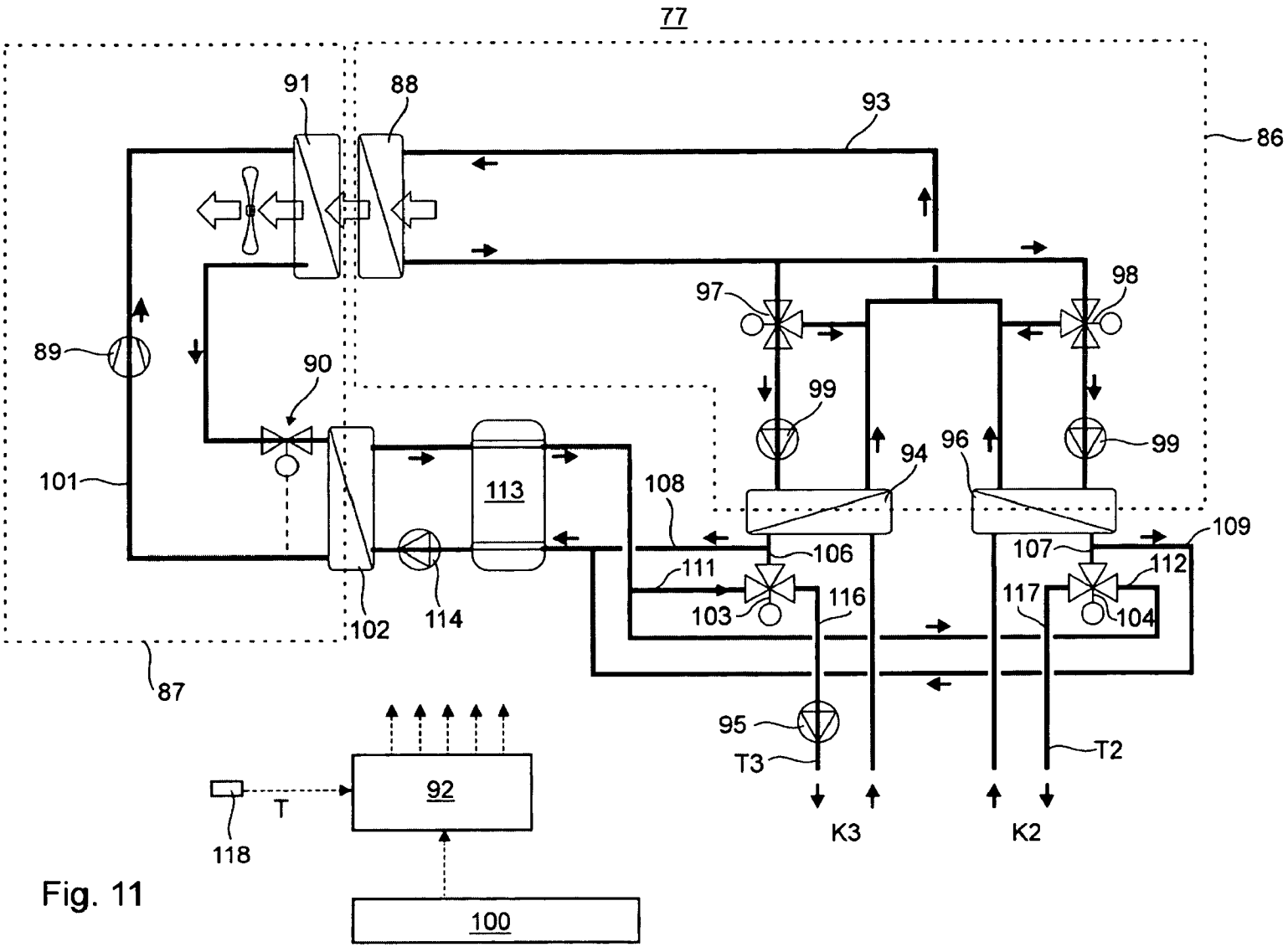

The refrigeration center 77 is provided for supplying the printing press, or for supplying the supply arrangements 71, with temperature-regulating medium from the second circuit K2, and advantageously from the third circuit K3. In a particularly advantageous embodiment, as shown in FIG. 11, the refrigeration center 77 is embodied in the form of a combination installation, which has two cooling processes 86, 87, which are coupled with each other. These are a first process 87 with a device 89, 90, 91, such as, for example, a refrigeration machine 89, 90, 91, for generating cold by compression, and a second process 86 with an arrangement 88 for cooling by the use of ambient or outside air. The first process 87 is configured for cooling a temperature-regulating medium to a temperature level $T_k$ below the ambient or outside temperature. However, it is essential here that the processes 86, 87 are coupled with each other in such a way that the two above mentioned circuits K2, K3 can be supplied with cold from both processes 86, 87. This supply can take place selectively, depending on the request for the required temperature level T2, T3 of the respective circuit K2, K3, by one or by the other of the processes 86, 87, or particularly by a combination of the two processes 86, 87. For this purpose, an intelligent control device 92 is provided for use in making the temperature-regulating medium available to the circuits K2, K3 by making optimum use of the arrangement 88 for cooling by the use of ambient or of outside air.

In a first coolant or fluid circuit 93, again as seen in FIG. 11, the first process 86 has the arrangement 88 for cooling by the use of ambient or outside air, hereinafter a free-cooling device 88 for short, which, for example, can be configured as a convection cooling device with or without an evaporator. The energy exchange takes place by thermal contact between the fluid of the fluid circuit 93 and ambient air and moreover, in the case of additional spraying with water, makes use of the cold which is caused by evaporation. On the output side, the free- cooling device 88 is coupled thermally by the fluid, such as, for example, by respective heat exchangers 94, 96, to the circuits K2, K3. It is, in particular, coupled to the return flows of the two circuits K2, K3 from which, after passing through the heat exchangers 94, 96, partial flows 106, 107 can be taken via controllable valves 103, 104, for return to the two circuits K2 and K3. The separated partial flow 108, 109 of larger or lesser size, depending on the requirements, is brought into thermal contact with the first process 87 before the required amount of fluid cooled in this process 87 is fed, via the valves 103, 104, into the circuits K2, K3. To regulate the flow volume which is passing through the heat exchangers 94, 96, on the side of the fluid circuit 93, respective controllable valves 97, 98 are, for example, provided. These valves 97, 98 separate the fluid flow into a flow flowing through the heat exchanger 94, 96, and a flow flowing into the return flow toward the arrangement 88. Depending on the heat exchanger branch, conveying of the fluid is provided by a pump 99.

The first process 87 is provided for lowering the fluid in the separated partial flows 108, 109 to a temperature level $T_k$ below the ambient temperature, and to make it available for rejoining the circuits K2, K3. To generate cold, the first process 87 has, for example, cooling assemblies, the device 89, 90, 91, in the form of a compressor 89, a radiator 91, such as, for example, as a free-cooling device 91, as well as a decompression valve 90, all in a fluid circuit 101. On the outlet side, the device 89, 90, 91, or the first process 87, is thermally coupled, downstream of the decompression valve 90, with the circuits K2 and K3. In particular, the process 87 is coupled via the heat exchanger with partial flows 111, 112, for use in the return of previously separated and subsequently cooled fluids into the two circuits K2 and K3. A reservoir 113 can be advantageously arranged between the heat exchanger 102 and the valves 103, 104, by which the partial flows 111, 112 are served and in which the separated partial flows 108, 109 are conducted. In this way, it is continuously possible to convey fluid in a circuit via a pump 114 from the reservoir 113 through the heat exchanger 102 and, on the other hand, to remove properly cooled fluid for return into the circuits K2 and K3.

The two return flows from K2 and K3 are initially brought into thermal contact with the second process 86 before they can, depending on the demands which are made on the respective desired temperatures $T2_{soll}$, $T3_{soll}$, be respectively divided into two partial flows. One partial flow is again immediately fed into the supply flow of the respective circuit K2, K3, while the other partial flow is brought into thermal contact with the first process 87 before fluid cooled in this process 87 is also returned into the supply flow of the respective circuits K2, K3. The respective ratio between the flows 106 to 111, or 107 to 112, is set by the control device 92 and can, in principle, lie between 0% to 100% to 100% to 0% of the respectively adjusted supply flow 116, 117. The supply flow 116, 117 can be provided from a mixture of the two partial flows 106 and 111, or 107 and 112, or by only one of the partial flows 106 or 111, or 107 or 112.

In particular for the case that, as mentioned above, and as shown in FIGS. 8 and 9 by solid lines for the circuit K3, the latter is not processed and is conveyed in the supply arrangement 71, a pump 95 can be provided in the supply flow 116 of the circuit K3. For the case, as shown in dashed lines in FIG. 9, the corresponding pump 95 can be provided in the supply arrangement 71.

The control device 92 receives desired temperatures $T2_{soll}$, $T3_{soll}$ for the temperature levels T2, T3 in the upstream area of the circuits K2, K3 from a computing and/or control arrangement 100 of the printing press, and receives the outside temperature $T_A$ from a temperature sensor 118. The computing and/or control arrangement 100 can be a part or a process of a press control device, a control console computer, or can also be a process in another control device which is assigned to the printing press. The cooling strategy is fixed by the control device 92 as a function of the desired temperatures $T2_{soll}$, $T3_{soll}$ and of the outside temperature $T_A$. The resulting settings of the involved valves 103, 104, such as, for example, the control valves 103, 104, and possibly also the valves 97, 98, as actuating members 103, 104, 97, 98, are made via signal connections, which are only drawn in schematically.

Possible operating situations of the method for adjusting the transfer of printing ink are described, by way of example in what follows, for a specific allowance of desired temperatures $T2_{soll}$, $T3_{soll}$, such as, for example, of $T2_{soll}$ with a value between 10° C. and 25° C., and of, $T3_{soll}$, with a value between 24° C. and 30° C. If the outside temperature $T_A$ of the air is, for example, $T_A$<apprx. 5° C., cooling, or supply, of the circuits K2 connected to the cooling arrangement 77, or in other words the rollers 54 and the cylinders 43, is provided to maximally apprx. 50% by use of the process 86, such as, for example, the free-cooling device 88, and the remaining requirement is provided via the refrigeration machine 89, 90, 91. Cooling, or supply, of the connected circuits K3, i.e. of the drive mechanisms, is provided, up to 100%, by the free-cooling device 88. The supply flow 116 is fed to 100% from the partial flow 106.

With increasing exterior temperature $T_A$, up to, for example, apprx. 20° C., cooling, or supply of the circuits K2, that are connected to the cooling arrangement 77, takes place in an increasing part via the refrigeration machine 89, 90, 91, and less and less from the free-cooling device 88. Cooling, or supply of the connected circuits K3 can still take place 100% via the free-cooling device 88 if, for example, a desired temperature $T3_{soll}$ of, for example 24 to 30° C. has been preset.

If the outside temperature $T_A$ lies at apprx. 20 to 24° C., cooling, or supply of the circuits K2 which are connected to the cooling arrangement 77 takes place, for example, exclusively by the use of the cooling arrangement 77. The feed flow 117 into the circuit K2 takes place, for example, 100% from the partial flow 112. Cooling, or supply of the connected circuits K3 takes place only in part via the free-cooling device 88, and for the other part takes place via the refrigeration machine 89, 90, 91.

If the outside temperature $T_A$ lies, for example, at apprx. 24° C. and higher, cooling, or supply of the circuits K2 and K3 which are connected to the cooling arrangement 77 takes place only via the refrigeration machine 89, 90, 91.

In addition to the influence of the previously-described outside temperature, the specification for the desired temperatures $T2_{soll}$, $T3_{soll}$, and in particular for the desired temperature $T2_{soll}$, can vary with the machine status of the printing press, and in particular can vary with the production speed V. However, for generating the desired value $T2_{soll}$, the lowest required desired temperature for all of the printing attachments 41, or of their forme cylinders 43 and screen rollers 54, to be supplied by the cooling arrangement 77, is decisive. Maintaining this lowest desired temperature must still be assured by specifying the desired temperature $T2_{soll}$. If in the course of the start-up of the press to higher production speeds V, this lowest desired temperature for the components 43, 54 to be temperature-regulated changes, it is also possible to raise the desired temperature $T2_{soll}$ by the use of the computing and/or control device 100. Along with a raising of the desired temperature $T2_{soll}$, the above-mentioned threshold temperatures for the various cooling combinations can also be upwardly displaced.

Figure 12:
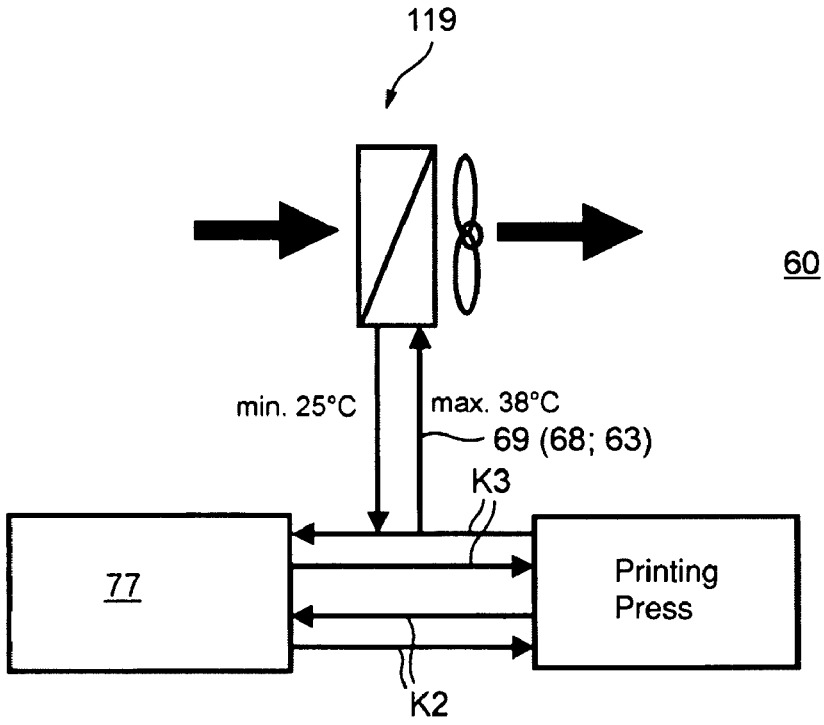
Figure 13:
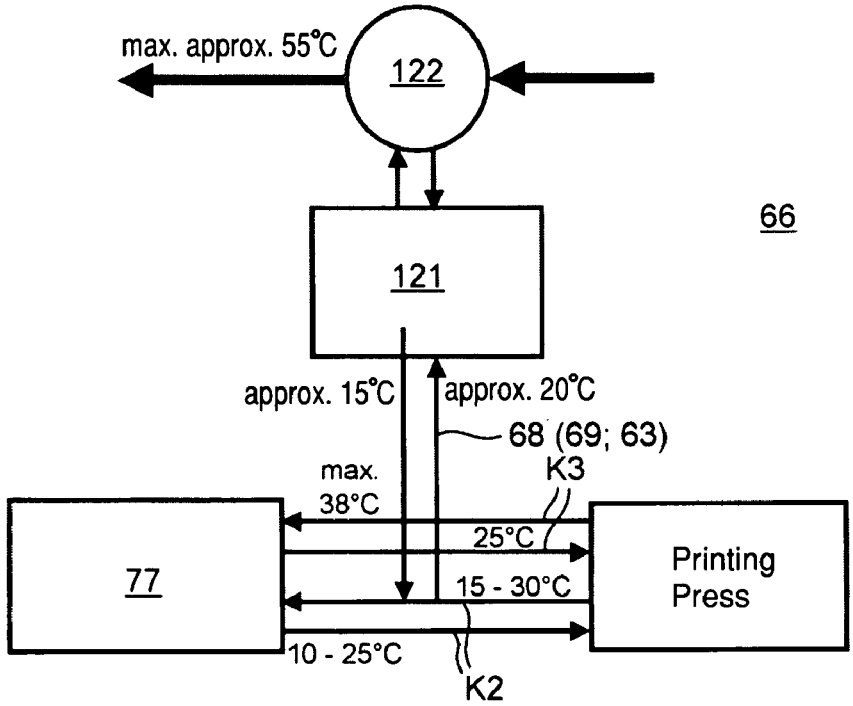

FIGS. 12 and 13 show two advantageous further developments, in which a portion of the heat energy is recovered. These further developments can be individually or mutually integrated into the above mentioned temperature regulation.

In the first embodiment, as shown in FIG. 12 a direct use of the warm return flow, for example of a maximum temperature of 35 to 40° C., and in particular, of apprx. 38° C., takes place from the circuit K3 for temperature-regulating the drive mechanisms M, for example by the use of a fluid-gas heat exchanger 119, such as, for example, a heat exchanger heating register, for direct heating of the air during winter operations.

In the second embodiment, as depicted in FIG. 13 a use of the temperature-regulating medium from the circuit K2 takes place as a heat source for a heat pump 121. By the use of the heat pump 121, it is possible to reach a higher temperature level in a reservoir 122, for example up to 55° C., than in the embodiment in accordance with FIG. 12, but an additional structural and energy layout becomes necessary.

The two regeneration concepts represented in FIGS. 12 and 13 can also make use of the respectively other source, such as K2 or K3 for example, in FIG. 12, of the return flow from K2, and in FIG. 13 of the return flow from K3. The systems can also have recourse to the heat flow 63, as may be seen in connection with FIG. 5 as the source.

While preferred embodiments of a method for adjusting the transfer of printing ink, in accordance with the present invention, have been set forth fully and completely hereinabove, it will be apparent to one of skill in the art that various changes in, for example, the specific nature of the drives for the cylinders, the number of printing units, and the like could be made without departing from the true spirit and scope of the present invention which is accordingly to be limited only by the appended claims.

What is claimed is:

1. A method for regulating the transfer of printing ink in a printing press including:

providing an inking system in said printing press and having a first roller with a first roller surface;

providing a forme cylinder with a forme cylinder surface, in said printing press and using said first roller for transferring ink from said inking system to said forme cylinder;

providing a first roller surface temperature regulating device and using said first roller surface regulating device for setting a desired surface temperature of said first roller surface;

providing a forme cylinder surface temperature regulating device and using said forme cylinder surface temperature regulating device for setting a desired surface temperature of said forme cylinder surface independently of said setting of said desired surface temperature of said first roller surface;

providing an adjusting device having a memory unit and using said adjusting device for controlling said first cylinder surface temperature regulating device and said forme cylinder temperature regulating device;

storing at least one of color-specific curves, support points regarding different printing inks and color types in said memory unit of said adjusting device at least for a connection between a production speed of said printing press and said first roller surface temperature and said forme cylinder surface temperature;

determining a change in said production speed for said printing press; and starting a change in at least one of said first roller surface temperature and said forme cylinder surface temperature before effecting said change in said production speed for said printing press.

2. The method of claim 1 further including providing an input and output unit including a monitor, displaying said connection as a display on said monitor selected from one of said color-specific curves, said support points regarding different printing colors and said color types, setting a first parameter of said printing ink by said desired first roller surface temperature, setting a second, different parameter of said printing ink by said desired forme cylinder roller surface temperature, said first parameter relating to a viscosity of said printing ink at said first roller surface, said second parameter relating to a tackiness of said printing ink at said forme cylinder surface.

3. The method of claim 1 further including determining a new production speed for said printing press and starting a change in said first roller surface temperature and said forme cylinder surface temperature before setting said new production speed of said printing press.

4. The method of claim 3 further including providing an input and output unit including a monitor, selecting said connection between said production speed and said first roller surface temperature and said forme cylinder surface temperature from one of a number of stored color-specific curves and support points for different printing colors and color types and displaying said connection on said monitor.

5. The method of claim 3 further including using said temperature regulating devices for setting a parameter of said printing ink.

6. The method of claim 3 further including setting a first parameter of said printing ink by said temperature at said first roller surface and setting a second parameter of said printing ink by said temperature at said forme cylinder surface.

7. The method of claim 6 further including providing said first parameter of said printing ink relating to its viscosity.

8. The method of claim 7 further including providing said second parameter of said printing ink relating to its tackiness.

9. The method of claim 8 further including using said viscosity and said tackiness of said printing ink for influencing an amount of said printing ink to be transported from a printing ink reservoir to a material to be printed.

10. The method of claim 8 further including having said tackiness effecting a separation of said printing ink between printing areas and non-printing areas of a printing forme on said forme cylinder.

11. The method of claim 8 further including having said tackiness effecting an amount of plucking between an ink conducting cylinder and a material to be printed.

12. The method of claim 7 further including reducing said viscosity of said printing ink for compensating for a decrease in an ability of said first roller for transferring said printing ink in response to an increase in a production speed of said printing press.

13. The method of claim 7 further including maintaining an ink conveying rate of said first roller constant over varying production speeds of said printing press by setting said viscosity.

14. The method of claim 3 further including completing said change in said first roller surface temperature and said forme cylinder surface temperature before setting said new production speed of said printing press.

15. The method of claim 1 further including providing an input and output unit including a monitor and displaying said connection between said production speed and said first roller surface temperature and said forme cylinder surface temperature for one of said different printing inks and said different color types on said display.

16. The method of claim 15 further including changing said connection displayed on said monitor by changing an input at said display.

17. The method of claim 16 further including changing said display of said connection within fixed boundaries.

18. The method of claim 16 further including changing said connection displayed on said monitor and showing said change in said displayed connection in said memory unit.

19. The method of claim 16 further wherein changing said connection displayed on said monitor charges said first roller surface temperature and said forme cylinder surface temperature with a temperature offset.

20. The method of claim 16 further including changing said stored connection in response to said changing of said displayed connection.

21. The method of claim 1 further including selectively performing said setting of said first roller surface temperature and said forme cylinder surface temperature.

* * * * *